US007306640B2

(12) United States Patent
Kuroki et al.

(10) Patent No.: US 7,306,640 B2
(45) Date of Patent: Dec. 11, 2007

(54) VACUUM CLEANER

(75) Inventors: Yoshiki Kuroki, Shiga (JP); Seiji Yamaguchi, Shiga (JP); Tomonori Kato, Shiga (JP); Masashi Okushima, Shiga (JP); Yuichi Shimizu, Shiga (JP); Tomomi Mitani, Shiga (JP); Hiroshi Mori, Shiga (JP); Toru Odachi, Shiga (JP); Yoshiaki Onishi, Shiga (JP); Hidenori Kitamura, Shiga (JP); Toshifumi Miyahara, Shiga (JP); Takaaki Ogawa, Shiga (JP); Hirokazu Nagaoka, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 717 days.

(21) Appl. No.: 10/690,757

(22) Filed: Oct. 23, 2003

(65) Prior Publication Data

US 2004/0128791 A1 Jul. 8, 2004

(30) Foreign Application Priority Data

| | | |
|---|---|---|
| Oct. 23, 2002 | (JP) | 2002-308250 |
| Nov. 11, 2002 | (JP) | 2002-326501 |
| Jan. 28, 2003 | (JP) | 2003-018762 |

(51) Int. Cl.
*B01D 45/12* (2006.01)

(52) U.S. Cl. ..... 55/337; 55/342; 55/418; 55/428; 55/467; 55/DIG. 3

(58) Field of Classification Search ..... 55/337, 55/342, 345, 418, 428, 467, DIG. 3
See application file for complete search history.

(56) References Cited

U.S. PATENT DOCUMENTS

| | | | | |
|---|---|---|---|---|
| 4,593,429 A * | 6/1986 | Dyson | ..... | 15/353 |
| 6,428,589 B1 | 8/2002 | Bair et al. | | |

FOREIGN PATENT DOCUMENTS

| | | |
|---|---|---|
| DE | 1927338 | 11/1965 |
| DE | 20020167 | 4/2001 |
| EP | 1074212 | 2/2001 |
| JP | 2001-104223 | 4/2001 |
| WO | 00/74548 | 12/2000 |

* cited by examiner

*Primary Examiner*—Robert Hopkins
(74) *Attorney, Agent, or Firm*—Bacon & Thomas PLLC

(57) ABSTRACT

A vacuum cleaner includes a first dirt separation unit and a second dirt separation unit. The first dirt separation unit has a first inlet port through which a suction air stream including dirt particles is introduced thereinto, and the second dirt separation unit has a second inlet port through which the air stream introduced into the first dirt separation unit is introduced into the second dirt separation. The first and the second inlet port are disposed such that they are not registered with each other. Accordingly, the dirt particles suctioned are separated in two stages, thereby decreasing the possibility of occlusion of a filter and rapid deterioration of a suction force.

21 Claims, 24 Drawing Sheets

VACUUM CLEANER

FIELD OF THE INVENTION

The present invention relates to a vacuum cleaner; and, more particularly, to a vacuum cleaner including a structure for collecting dirt particles.

BACKGROUND OF THE INVENTION

Referring to FIG. 26, there is illustrated a conventional vacuum cleaner including dirt collecting chamber 141 with a bottom, and air inlet 142 provided in a side wall of dirt collecting chamber 141. A dirt-entrained air stream is tangentially introduced through air inlet 142 into dirt collecting chamber 141. Cover 144 is provided to cover upper opening 143 of dirt collecting chamber 141 and air outlet 145 is formed in cover 144. Further, there is provided filter 146 such that it covers upper opening 143 of dirt collecting chamber 141. Upon operation of the vacuum cleaner, dirt particles are suctioned from suction port 148 and collected through air inlet 142 in dirt collecting chamber 141. The collected dirt particles are centrifugally separated in dirt collecting chamber 141 and dirt-free air is exhausted through, in turn, filter 146 and air outlet 145 (see, e.g., Japanese Patent Laid-open Publication No. 2001-104223).

In such conventional arrangements, the dirt particles collected via air inlet 142 in dirt collecting chamber 141 adhere to filter 146 to occlude it, thereby resulting in deterioration of a force for suctioning the dirt particles. In order to solve the above problems, an area of filter 146 may be increased; however, the sizes of dirt collecting chamber 141 and the vacuum cleaner themselves should be increased accordingly.

SUMMARY OF THE INVENTION

It is, therefore, an object of the present invention to provide a vacuum cleaner capable of maintaining suction performance thereof by preventing deterioration of a suctioning force without increasing the size thereof.

In accordance with an aspect of the present invention, there is provided a vacuum cleaner comprising: a first dirt separation unit having a first inlet port through which a suction air stream including dirt particles is introduced thereinto; and a second dirt separation unit having a second inlet port through which the air stream introduced into the first dirt separation unit is introduced into the second dirt separation, wherein the first and the second inlet port are disposed not to face each other.

In the present invention, the dirt particles suctioned are separated in two stages, thereby decreasing the possibility of occlusion of a filter and rapid deterioration of a suction force.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF PREFERRED EMBODIMENTS

A first preferred embodiment of the present invention will now be described with reference to FIGS. 1 to 12.

Figure 1:
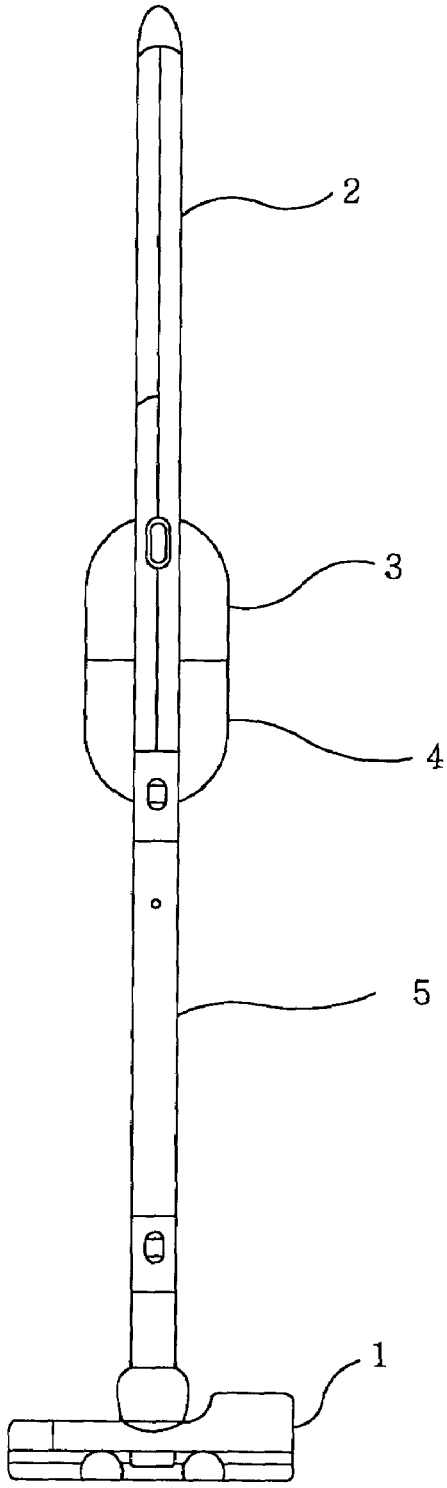
FIG. 1 is a front view of a vacuum cleaner in accordance with a first preferred embodiment of the present invention.

FIG. 1 is a front view of a vacuum cleaner in accordance with the first preferred embodiment of the present invention.

The vacuum cleaner includes suction inlet unit 1 through which dirt particles on a floor are suctioned; handle member 2 having a grip portion; electric blower chamber 3 incorporating therein an electric blower for generating a suction air stream, electric blower chamber 3 being attached to handle member 2; dirt separation and accumulation unit 4 detachably secured to a bottom portion of electric blower chamber 3; and extension tube 5 having a suction passage for allowing dirt separation and accumulation unit 4 to communicate with suction inlet unit 1, extension tube 5 connecting suction inlet unit 1 to handle member 2. Provided in handle member 2 is an exhaust port (not shown) for discharging dirt particles passing through an interior of extension tube 5 to dirt separation and accumulation unit 4.

Figure 2:
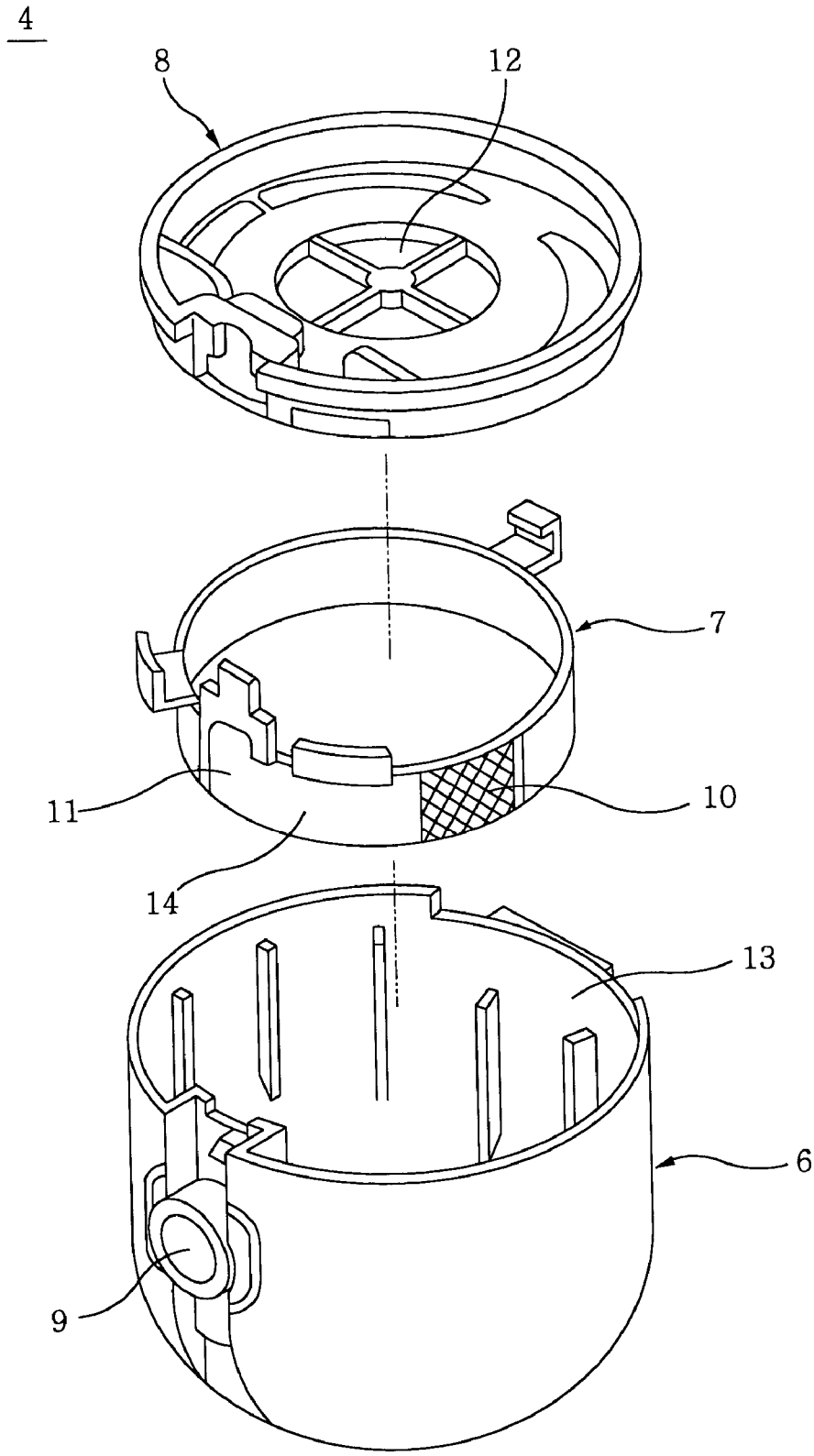
FIG. 2 provides a schematic exploded view of a dirt accumulating unit of the vacuum cleaner.
Figure 3:
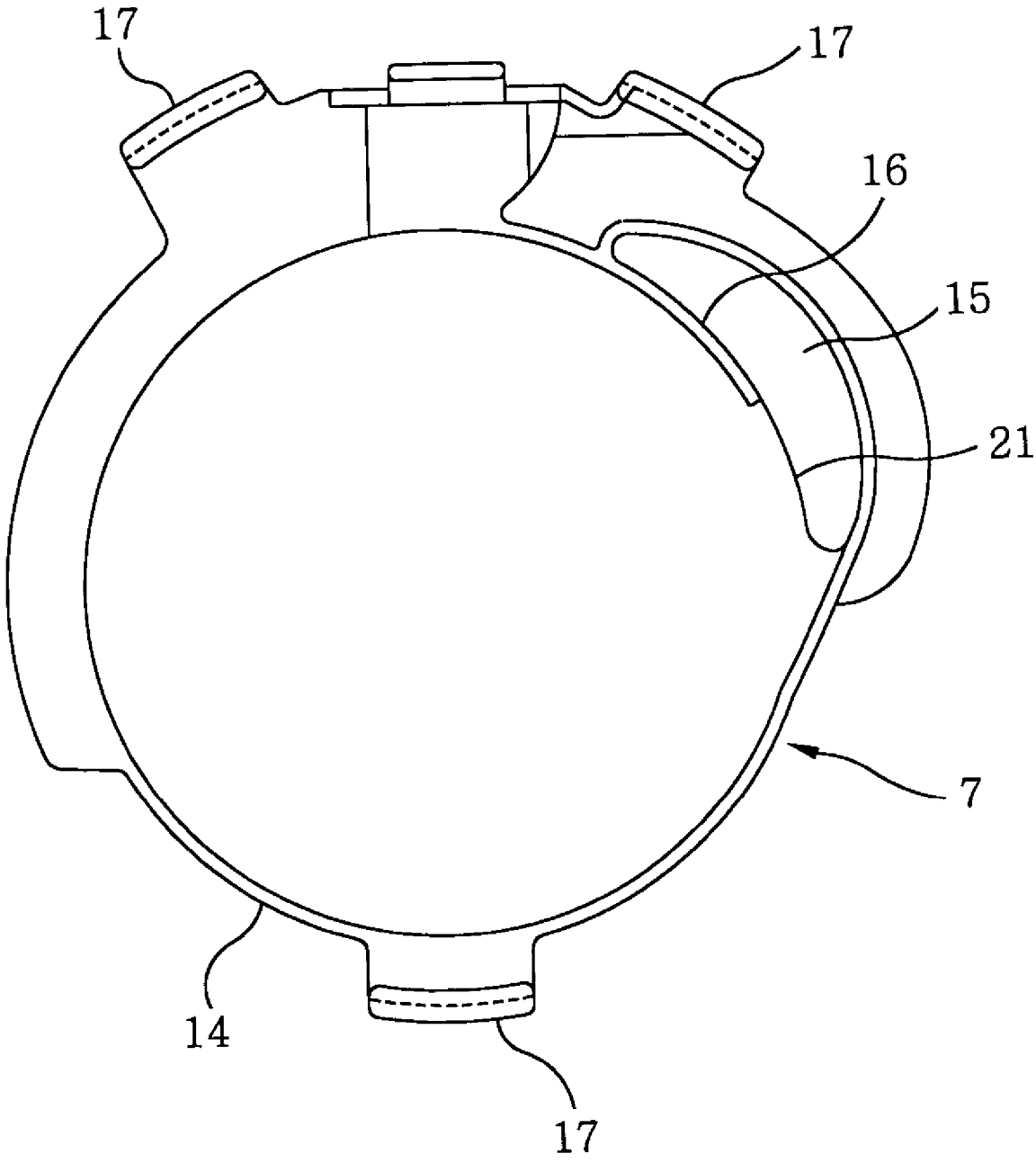
FIG. 3 sets forth a top view of a second dirt separation unit of the dirt accumulating unit.
Figure 4:
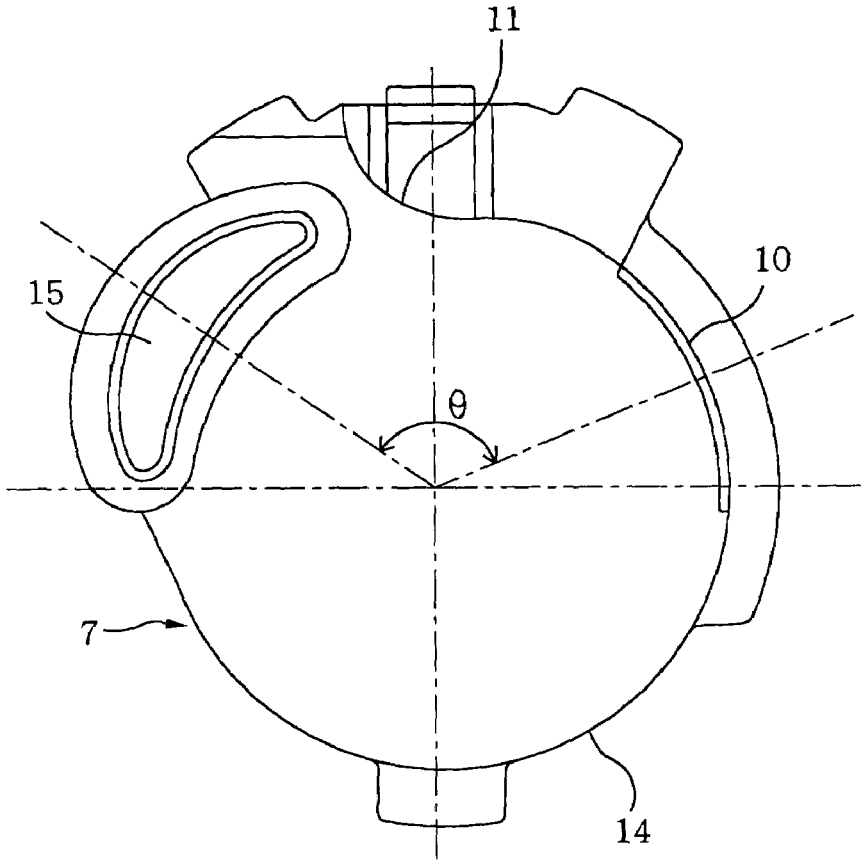
FIG. 4 depicts a bottom view of the second dirt separation unit of the dirt accumulating unit.
Figure 5:
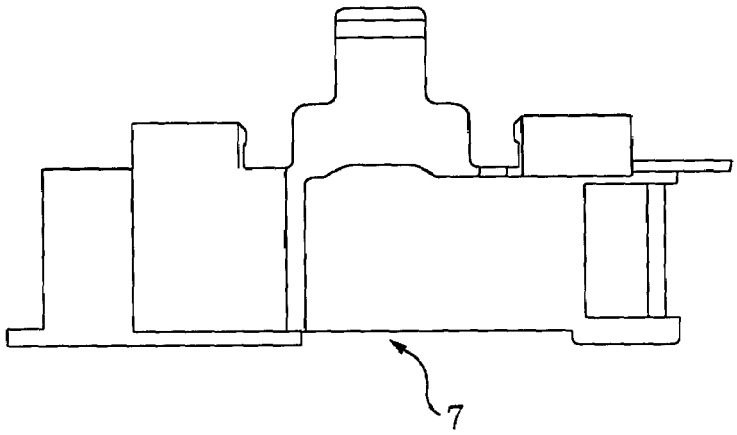
FIG. 5 offers a front view of the second dirt separation unit of the dirt accumulating unit.
Figure 6:
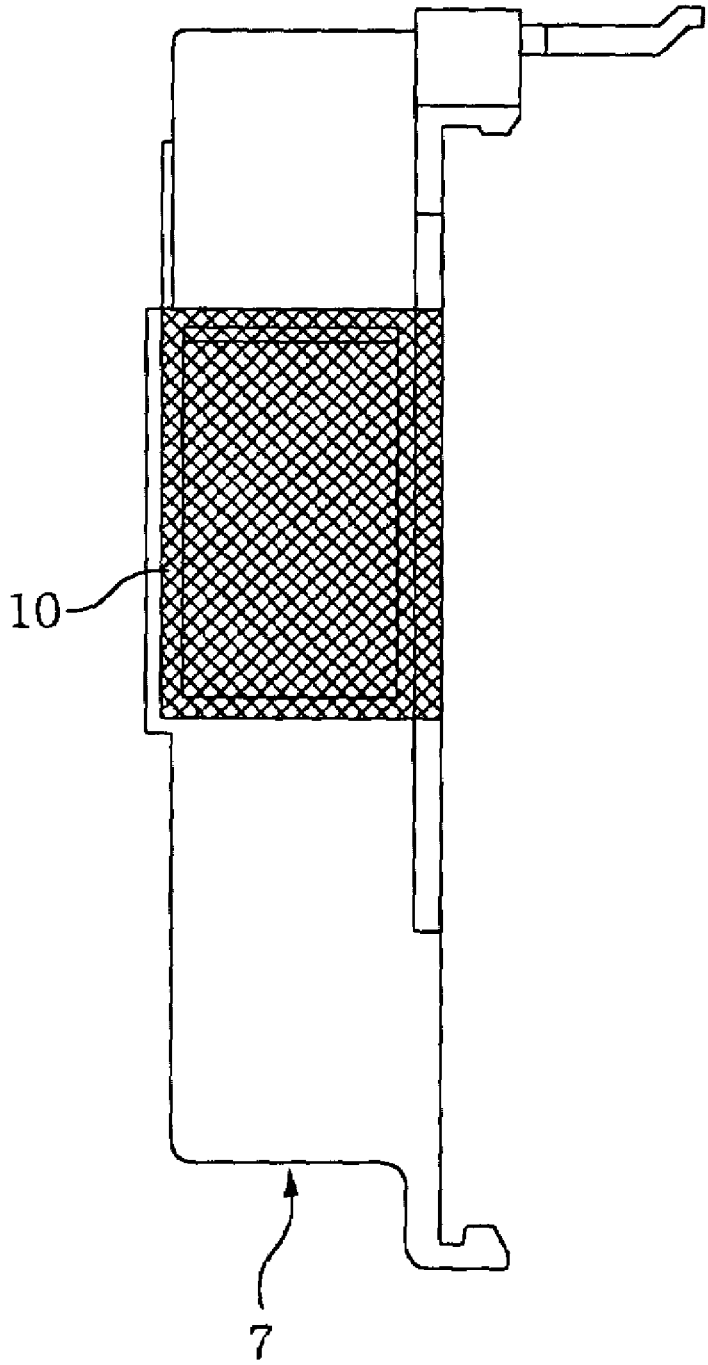
FIG. 6 shows a side view of the second dirt separation unit of the dirt accumulating unit.

Referring to FIG. 2, there is illustrated dirt separation and accumulation unit 4 of the vacuum cleaner including first dirt separation unit 6, second dirt separation unit 7 and dirt collecting cover 8. First dirt separation unit 6 has an upper wall of an approximately cylindrical configuration and a lower wall of an approximately semi-spherical configuration. Further, first inlet port 9 of an approximately circular shape in section is provided to the walls of first dirt separation unit 6 opposite to the exhaust port of handle member 2. Second dirt separation unit 7 has an approximately cylindrical wall with a diameter less than that of the upper wall of first dirt separation unit 6. Top of second dirt separation unit 7 is opened and bottom thereof is closed. Dirt collecting cover 8 is of an approximately cylindrical shape with a soft or elastic material such as elastomer provided on a circumferential end thereof. An outer diameter of the soft material is set to be tightly fitted with an inner periphery of the upper wall of first dirt separation unit 6. Reference numeral 10 represents a second inlet port for introducing dirt particles into second dirt separation unit 7. Second inlet port 10 is located not to face first inlet port 9.

FIGS. 3 to 6 are a top view, a bottom view, a front view and a side view of second dirt separation unit 7 of the vacuum cleaner, respectively. Reference numeral 14 represents an approximately cylindrical wall portion of second dirt separation unit 7, and reference numeral 11 represents a gradually curved guide portion contacting with an outer periphery of wall portion 14. Reference numeral 15 represents a first opening provided in the bottom of second dirt separation unit 7 by cutting away a part of wall portion 14, and reference numeral 16 represents a guide disposed at an outer periphery of first opening 15 on a downstream side of an air stream introduced through second inlet port 10 into second dirt separation unit and flowing along an inner periphery of wall portion 14, guide 16 having a same configuration as that of wall portion 14. Reference numeral 17 represents claws adapted to be coupled with dirt collecting cover 8. Angle θ defined by a straight line connecting centers of wall portion 14 and first opening 15 and a straight line connecting the centers of wall portion 14 and second inlet port 10 provided to second dirt separation unit 7 is set to be 90° or greater. Further, reference numeral 21 represents second opening for allowing an interior of second dirt separation unit 7 to communicate with first opening 15.

Figure 7:
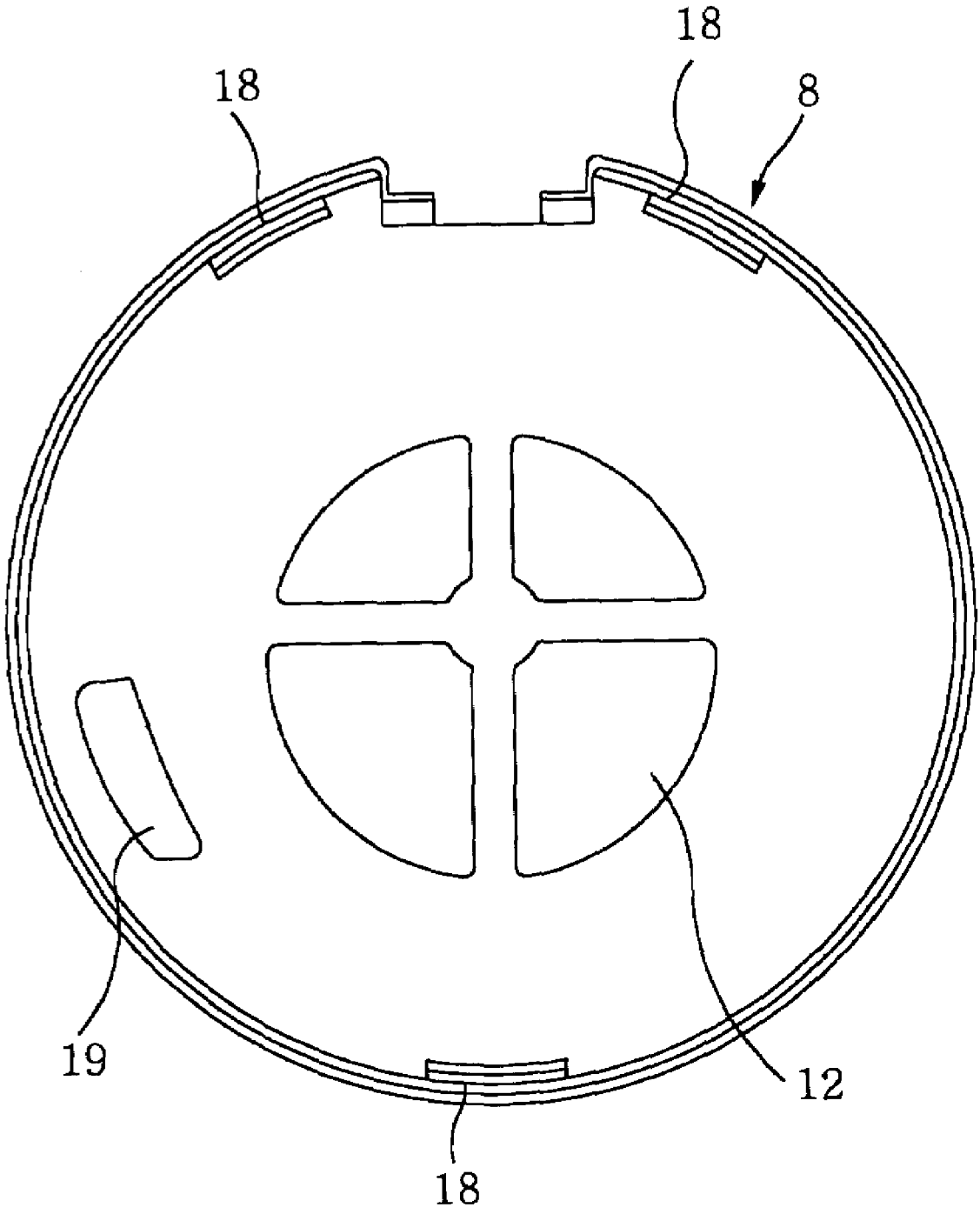
FIG. 7 illustrates a bottom view of a dirt collecting cover.

FIG. 7 is a bottom view of dirt collecting cover 8. Reference numeral 12 represents a first communication opening for allowing a suction port of electric blower chamber 3 to communicate with the interior of second dirt separation unit 7, and reference numeral 18 represents coupling portions with which respective claws 17 of second dirt separation unit 7 are engaged. Reference numeral 19 represents a second communication opening disposed on a downstream side of a circulating flow generated when an air stream introduced through first inlet port 9 into first dirt separation unit 6 travels along the outer periphery of wall portion 14 of second dirt separation unit 7, second communication opening 19 allowing electric blower chamber 3 to communicate with an interior of first dirt separation unit 6.

Figure 8:
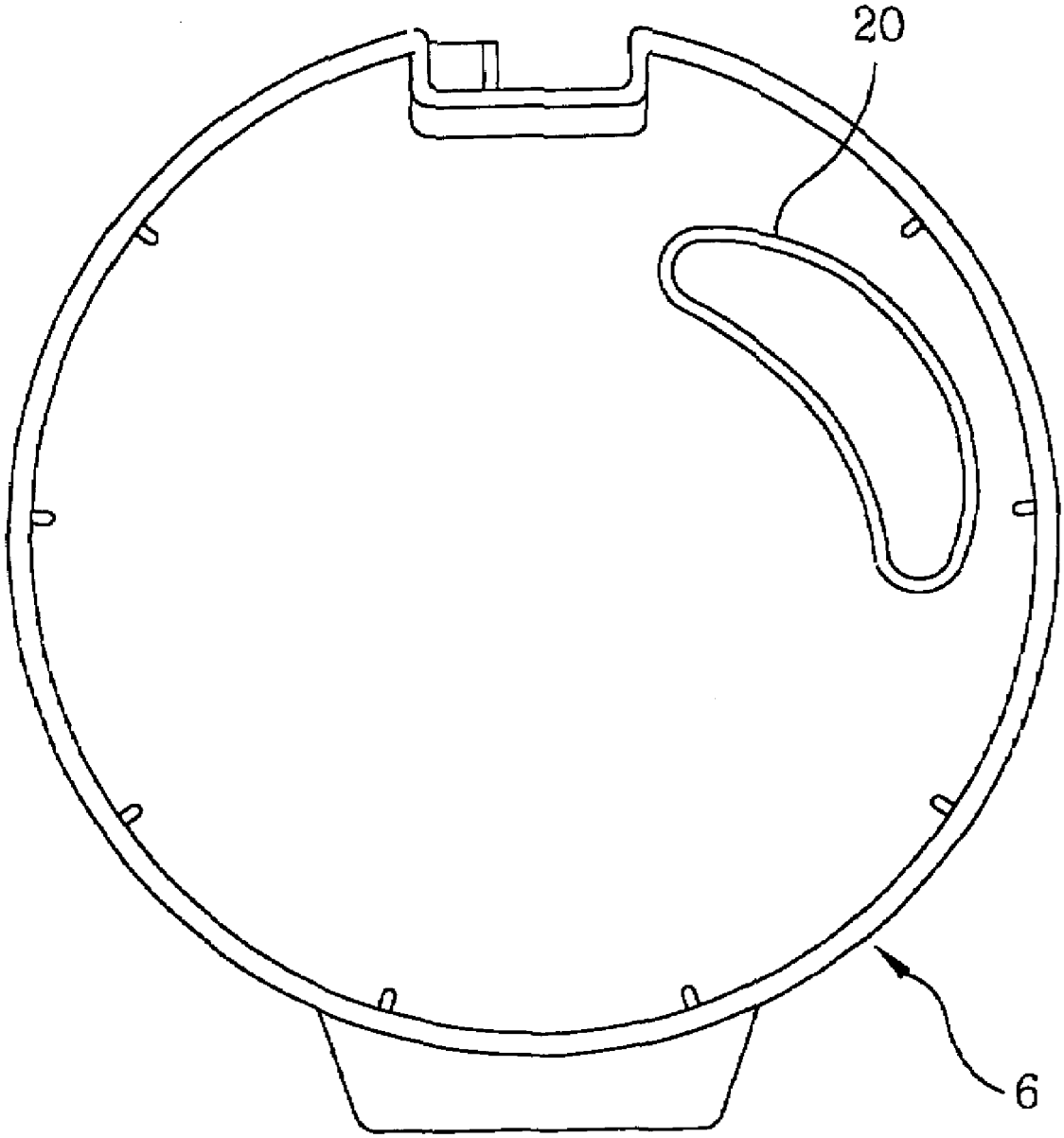
FIG. 8 presents a top view of a first dirt separation unit of the dirt accumulating unit.

FIG. 8 is a top view of first dirt separation unit 6. Reference numeral 20 represents a dirt accumulating part aligned with first opening 15 of second dirt separation unit 7 and extending upwardly to make a contact with an outer periphery of first opening 15.

Figure 9:
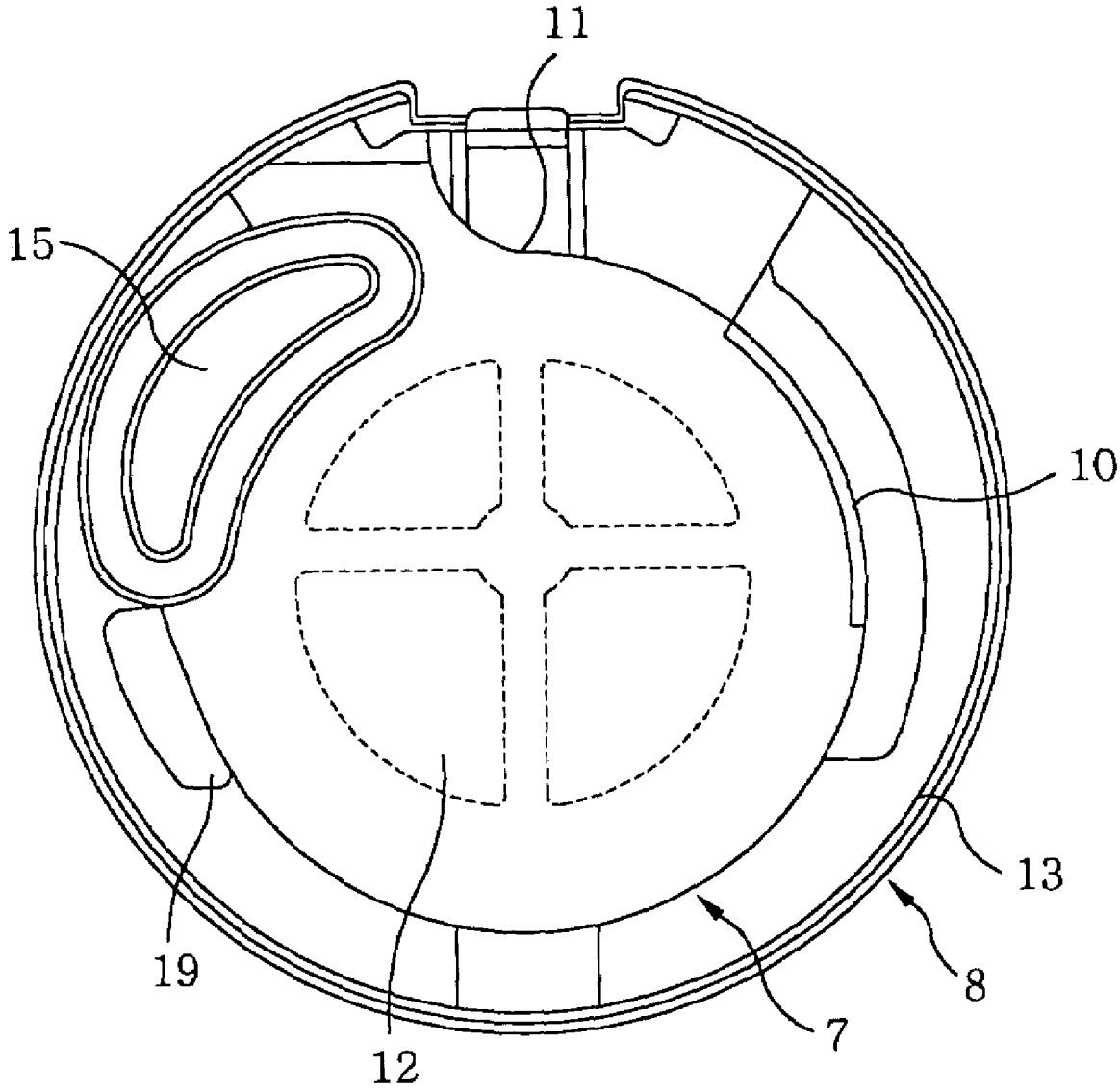
FIG. 9 is a bottom view of a combined structure of the second dirt separation unit and the dirt collecting cover.
Figure 10:
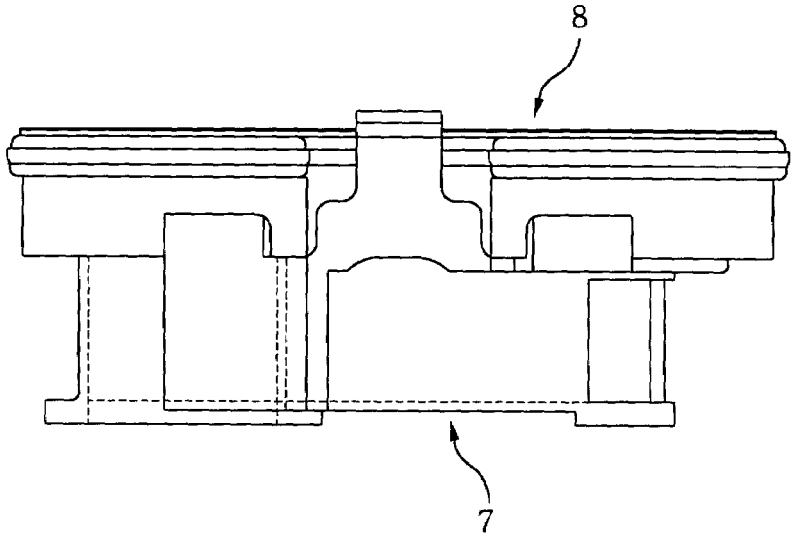
FIG. 10 represents a front view of the combined structure of the second dirt separation unit and the dirt collecting cover.

FIGS. 9 and 10 are a bottom view and a top view of the second dirt separation unit and the dirt collecting cover assembled together, respectively.

Figure 11:
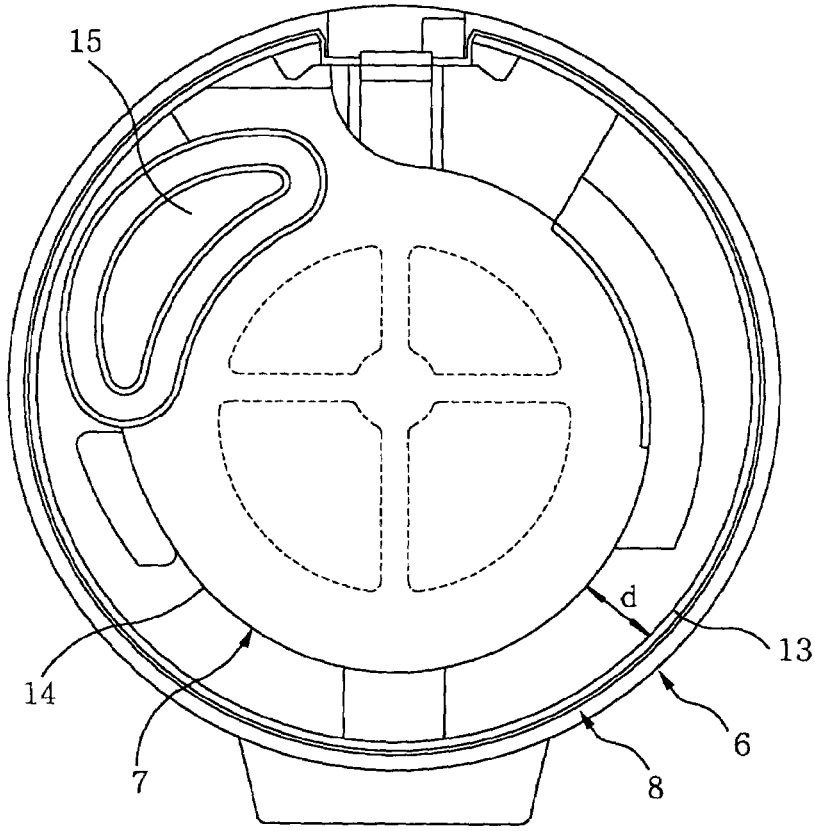
FIG. 11 provides a bottom view of a combined structure of the first dirt separation unit, the second dirt separation unit and the dirt collecting cover.
Figure 12:
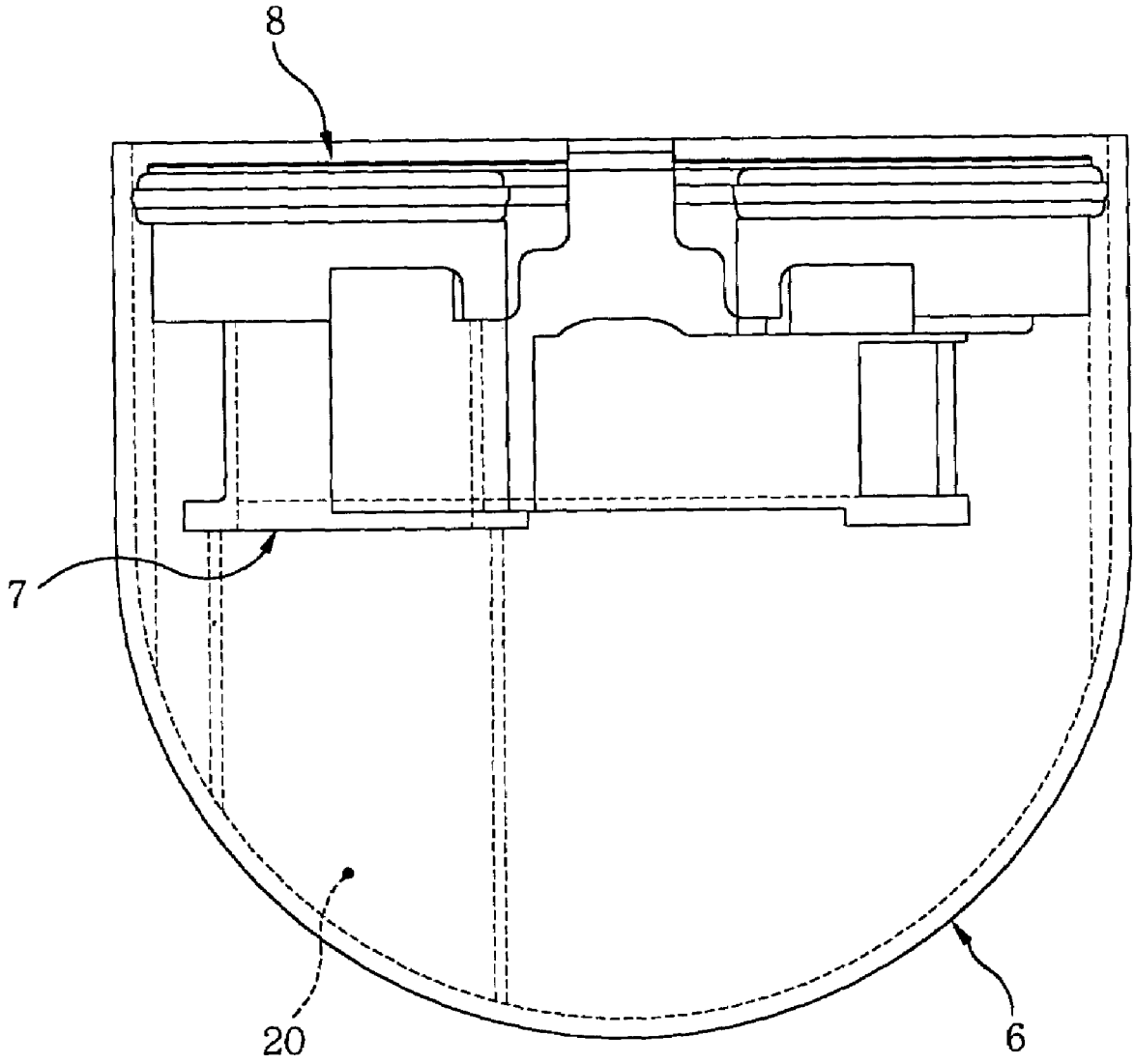
FIG. 12 sets forth a phantom view of the combined structure of the second dirt separation unit and the dirt collecting cover.

FIGS. 11 and 12 are a bottom view and a phantom view of an assembly of the first dirt separation unit, the second dirt separation unit and the cover coupled together, respectively. Wall portion 13 of first dirt separation unit 6 is of an approximately cylindrical configuration, and distance d between wall portions 13 and 14 is gradually reduced while moving along toward downstream of the circulation flow along the outer periphery of cylindrical wall portion 14 of second dirt separation unit 7.

Operation of the arrangements as described above will now be described. Dirt particles suctioned through suction inlet unit 1 pass through extension tube 5 and exhaust port (not shown) of handle member 2 and are then introduced via first inlet port 9 into first dirt separation unit 6. The air stream including the dirt particles introduced into first dirt separation unit 6 via first inlet port 9 begins to smoothly flow along an outer periphery of second dirt separation unit 7 by guide 11 gradually curved.

The circulating dirt particles then reach second inlet port 10. Under a centrifugal force, heavy dirt particles pass by second inlet port 10 and further travel to a deep inner side of first dirt separation unit 6, while light dirt particles are suctioned via second inlet port 10 into second dirt separation unit 7. In this way, a first stage of dirt separation is carried out. In the first stage of dirt separation, since distance d between wall portion 13 of first dirt separation unit 6 and wall portion 14 of second dirt separation unit 7 is gradually reduced as moving along toward downstream of the circulation flow along the outer periphery of wall portion 14 of second dirt separation unit 7, the speed of the circulation flow is not significantly decreased so that the operation can efficiently be performed. Furthermore, the heavy dirt particles, which have passed by second inlet port 10 to the deep inner side of first dirt separation unit 6, finally are stopped and accumulated on an inner bottom surface of first dirt separation unit 6.

On the other hand, the light dirt particles suctioned into second dirt separation unit 7 via second inlet port 10 thereof begin to travel along the inner periphery of wall portion 14. The light dirt particles are then introduced into first opening 15 via a passage (second opening 21) which is formed by cutting away a part of wall portion 14 to be accumulated in dirt accumulation part 20. In this way, a second stage of dirt separation is carried out. Further, dirt particles, which would pass by first opening 15 due to their high flowing speed, are blocked by guide 16 and then introduced and accumulated in dirt accumulation part 20 via first opening after losing their speeds. The dirt-free air stream circulates inside second dirt separation unit 7 and is discharged from dirt separation and accumulation unit 4 via first communication opening 12. The discharged air stream travels through electric blower chamber 3 and is then evacuated to outside via an evacuation opening provided to electric blower chamber 3.

First communication opening 12 is provided with an air permeable filter for preventing fine dirt particles from entering an electric blower, and second inlet port 10 of second dirt separation unit 7 is provided with an air permeable filter for limiting the size of dirt particles suctioned into second dirt separation unit 7. The filter of first communication opening 12 has a mesh size equal to or less than that of the filter of second inlet port 10 so that a pressure loss through the filter of second inlet port 10 is equal to or less than a pressure loss through the filter of first communication opening 12, thereby ensuring that dirt particles are suctioned into second dirt separation unit 7.

Further, in addition to first communication opening 12, second communication opening 19 which allows the interior of first dirt separation unit 6 to communicate with electric blower chamber 3 is also provided to dirt collecting cover 8 so that a total communication area through which dirt particles in first dirt separation unit 6 are suctioned is increased, thereby further reducing occlusion of each communication opening and inlet port. As a result, after separated by the filter of second inlet port 10 of second dirt separation unit 7, the dirt particles are more accumulated in first dirt separation unit 6. Further, second communication opening 19 is provided with an air permeable filter whose mesh size is equal to or greater than that of the filter of second inlet port 10 of second dirt separation unit 7 so that larger amount of suction air stream is drawn to first dirt separation unit 6. With such arrangements, occlusion of second inlet port 10 of second dirt separation unit 7 and hence decrease of an air stream flowing thereinto are reduced or retarded, and the amount of dirt particles suctioned and accumulated in first dirt separation unit 6 is increased.

Second dirt separation unit 7 is detachably coupled to dirt collecting cover 8 by engaging claws 17 with coupling portions 18. Further, dirt collecting cover 8 is detachably coupled to first dirt separation unit 6 by tightly fitting the outer periphery of the former into wall portion 13 of the latter. Accordingly, bulky dirt particles accumulated in first dirt separation unit 6 and fine dirt particles accumulated in dirt accumulation part 20 provided in first dirt separation unit 6 can be readily removed by detaching dirt collecting cover 8 from first dirt separation unit 6. Even though dirt particles adhere to second inlet port 10, they can be removed with ease, thereby facilitating maintenance thereof.

Since second dirt separation unit 7 is also detachably coupled to dirt collecting cover 8, it is easy to clean the interior of second dirt separation unit 7. Even if dirt particles adhere to first communication opening 12 of dirt collecting cover 8, they can easily be removed, thereby facilitating maintenance thereof.

In this embodiment, although a broom-typed vacuum cleaner is described, it is appreciated that the above arrangements may be employed to general vacuum cleaners without regard to a power supply type or a configuration thereof.

A vacuum cleaner in accordance with a second preferred embodiment of the present invention will now be described with reference to FIGS. 13 to 19.

Figure 13:
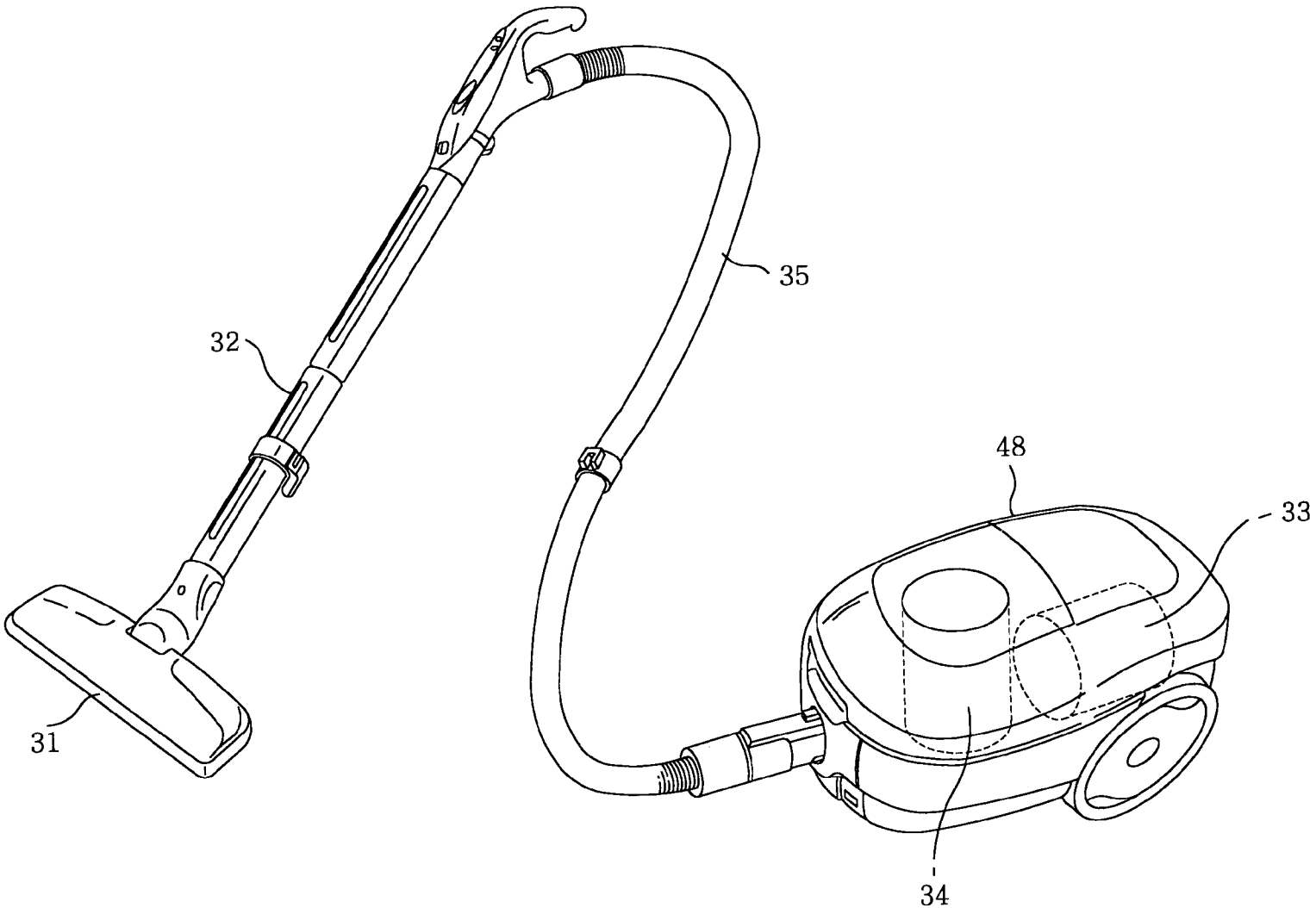
FIG. 13 describes a perspective view of a vacuum cleaner in accordance with a second preferred embodiment of the present invention.

FIG. 13 is a perspective view of the vacuum cleaner in accordance with the second preferred embodiment. The vacuum cleaner includes suction inlet unit 31 for suctioning dirt particles on a floor, main body 48 incorporating therein electric blower 33 for generating a suction air stream, extension tube 32 with an end connected to suction inlet unit 31, dirt collecting unit 34 detachably mounted in main body 48 for collecting dirt particles, dirt collecting unit 34 communicating with suction inlet unit 31 through a suction passage inside extension tube 32, and hose 35 connecting extension tube 32 to dirt collecting unit 34. Main body 48 is provided with an evacuation opening (not shown) through which an evacuation air stream generated by electric blower 33 is discharged.

Figure 14:
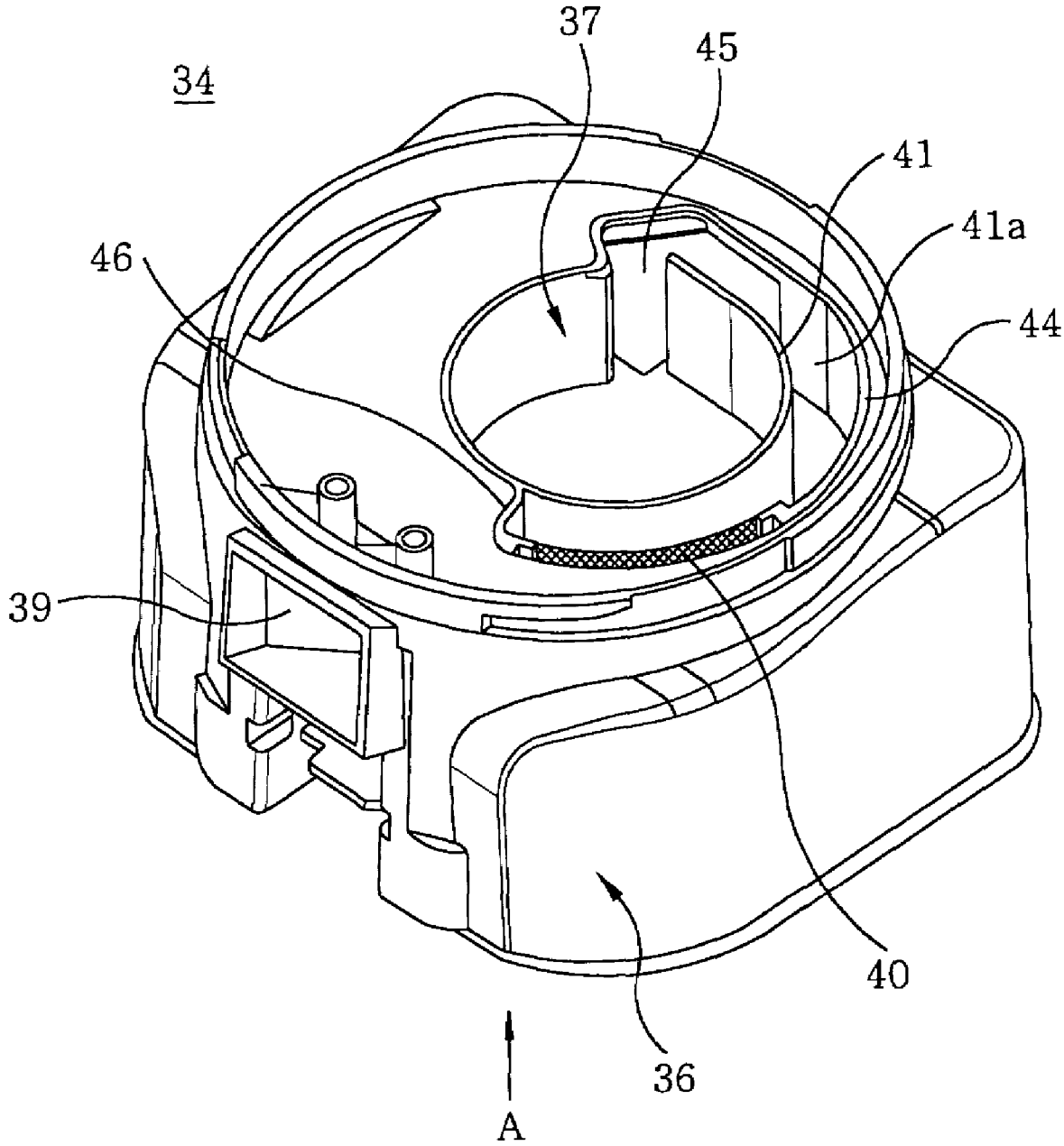
FIG. 14 illustrates a schematic perspective view of a dirt collecting part of the vacuum cleaner.
Figure 15:
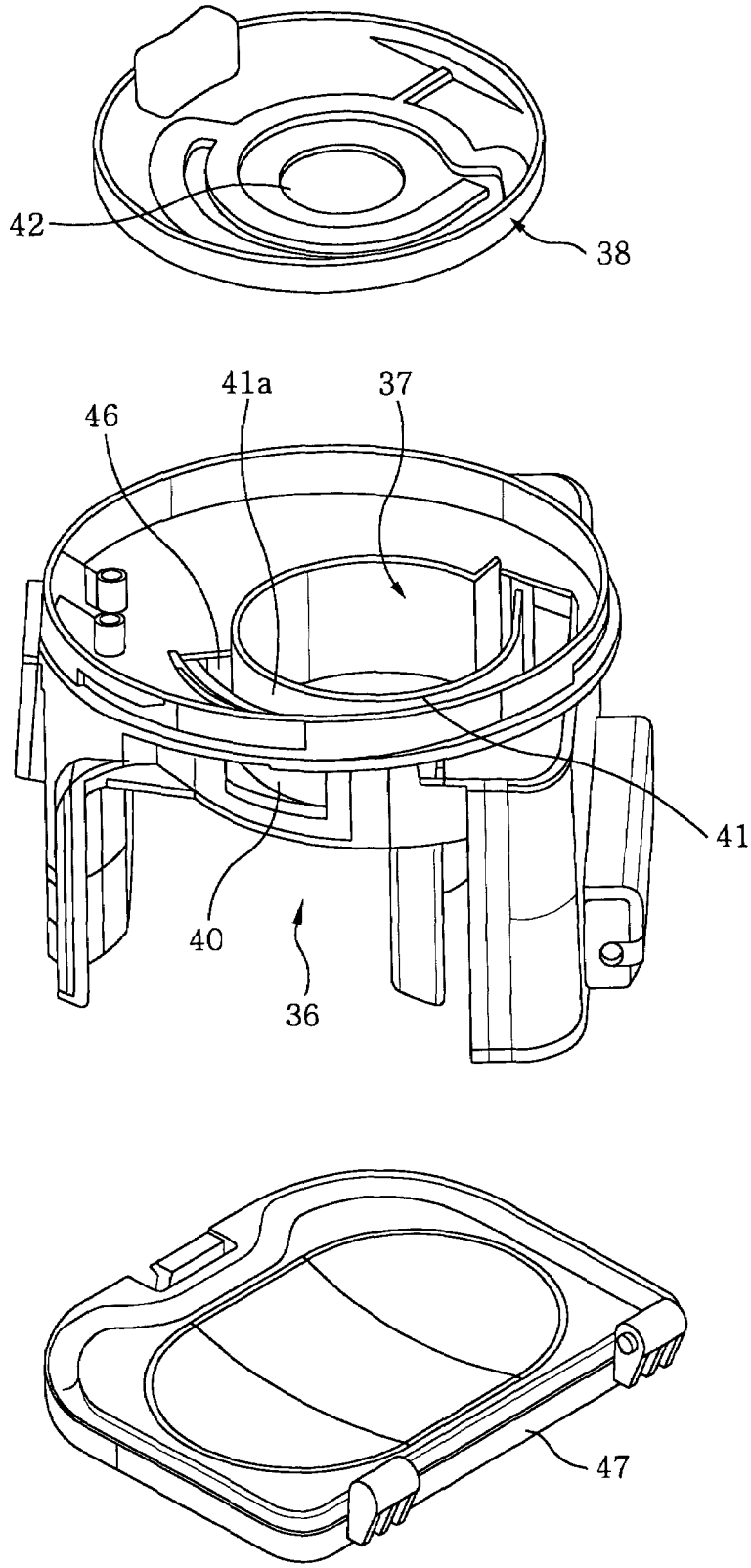
FIG. 15 represents an exploded view of the dirt collecting part.
Figure 16:
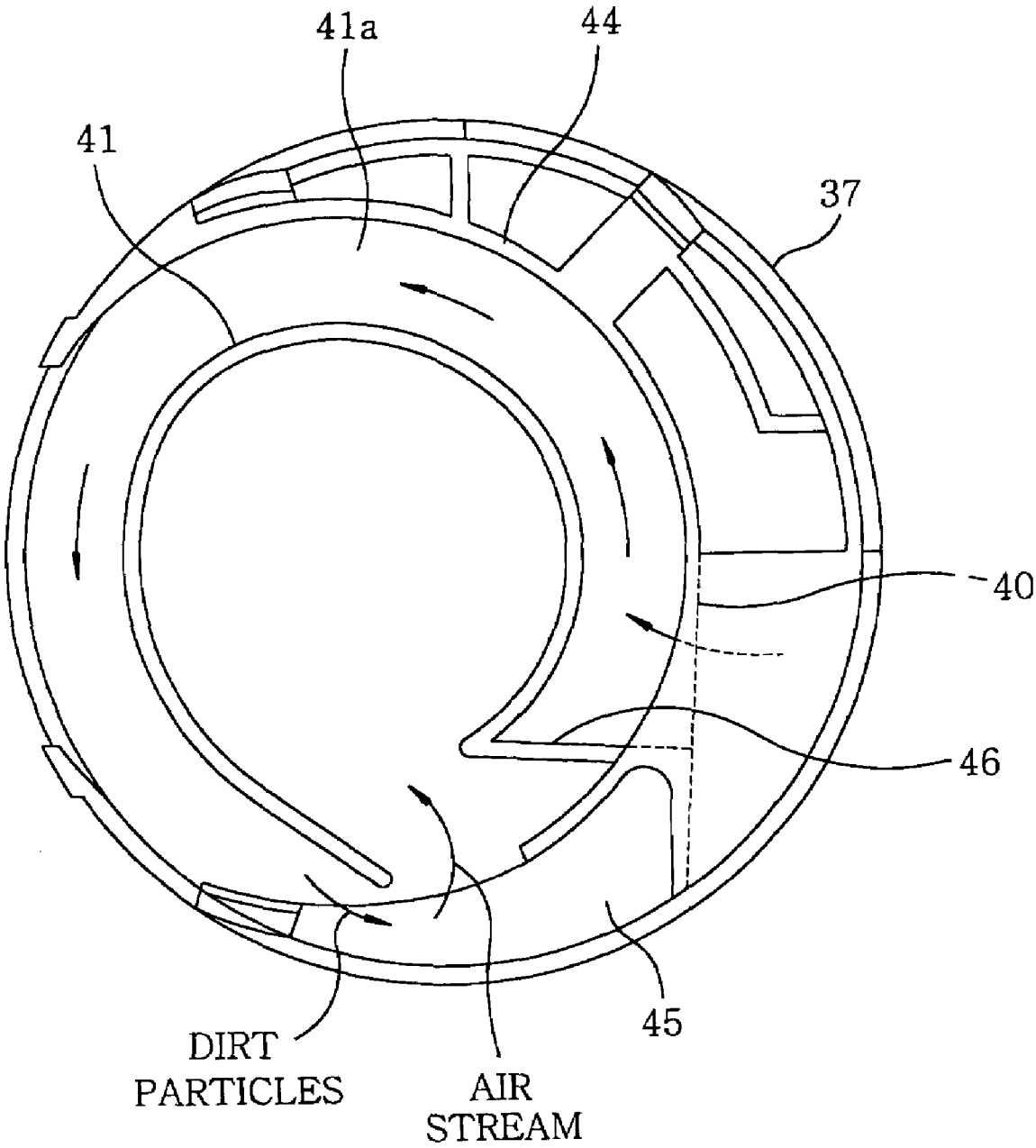
FIG. 16 is a top view of a second dirt separation unit of the dirt collecting part.

FIGS. 14 to 16 are views showing dirt collecting unit 34 including first dirt separation unit 36, second dirt separation unit or centrifugal separation part 37 and cover 38. First dirt separation unit 36 is covered with lid 47 for closing and opening an opened bottom thereof. Further, first dirt separation unit 36 has first inlet port 39 through which an air stream including dirt particles is introduced thereinto via hose 35 from suction inlet unit 31. Centrifugal separation part 37 has a diameter less than that of first dirt separation unit 36 and an approximately circular space therein. Centrifugal separation part 37 is disposed inside first dirt separation unit 36. Dirt collecting cover 38 of an approximately cylindrical configuration has a soft or elastic material such as elastomer provided on an outer periphery thereof. Dirt collecting cover 38 is disposed in downstream of centrifugal separation part 37. Reference numeral 42 represents a first communication opening through which a suction port (not shown) of electric blower 33 communicates with an interior of centrifugal separation part 37. First communication opening 42 is covered with a filter. Reference numeral 40 represents a second inlet port of an approximately arc shape through which an air stream including dirt particles is introduced into centrifugal separation part 37. Second inlet port 40 is covered with a filter (not shown) and is disposed not to face first inlet port 39. Second inlet port 40 is detachable so that the filter can be cleaned.

Reference numeral 44 represents an approximately cylindrical-shaped outer wall portion of centrifugal separation part 37 and reference numeral 41, an inner wall portion of an approximately arc configuration disposed inside and along outer wall portion 44 of centrifugal separation part 37 to form together circular passageway 41*a* along which an air stream including dirt particles introduced from second inlet port 40 travels. Only an inner side of inner wall portion 41 communicates with first communication opening 42. Reference numeral 45 represents a first opening provided in the bottom of centrifugal separation part 37 on a downstream side of circular passageway 41*a* and on an outside of inner wall portion 41, and reference numeral 46 represents a guide portion extended from inner wall portion 41 to contact with outer wall portion 44 of centrifugal separation part 37, only a downstream portion of circular passageway 41*a* communicating with first opening 45.

Figure 17:
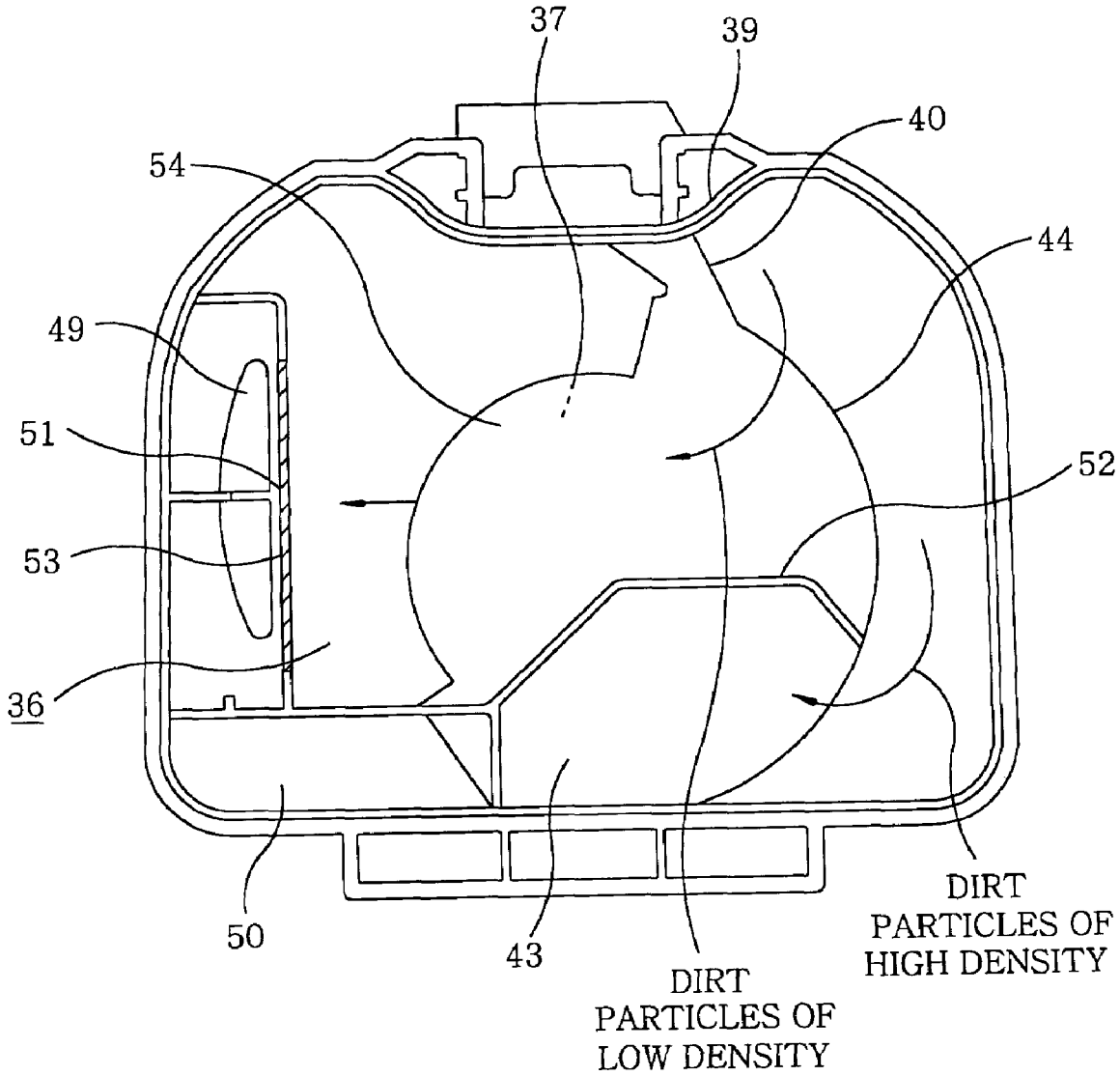
FIG. 17 is a view of the dirt collecting part as viewed in a direction indicated by arrow A in FIG. 14.
Figure 18:
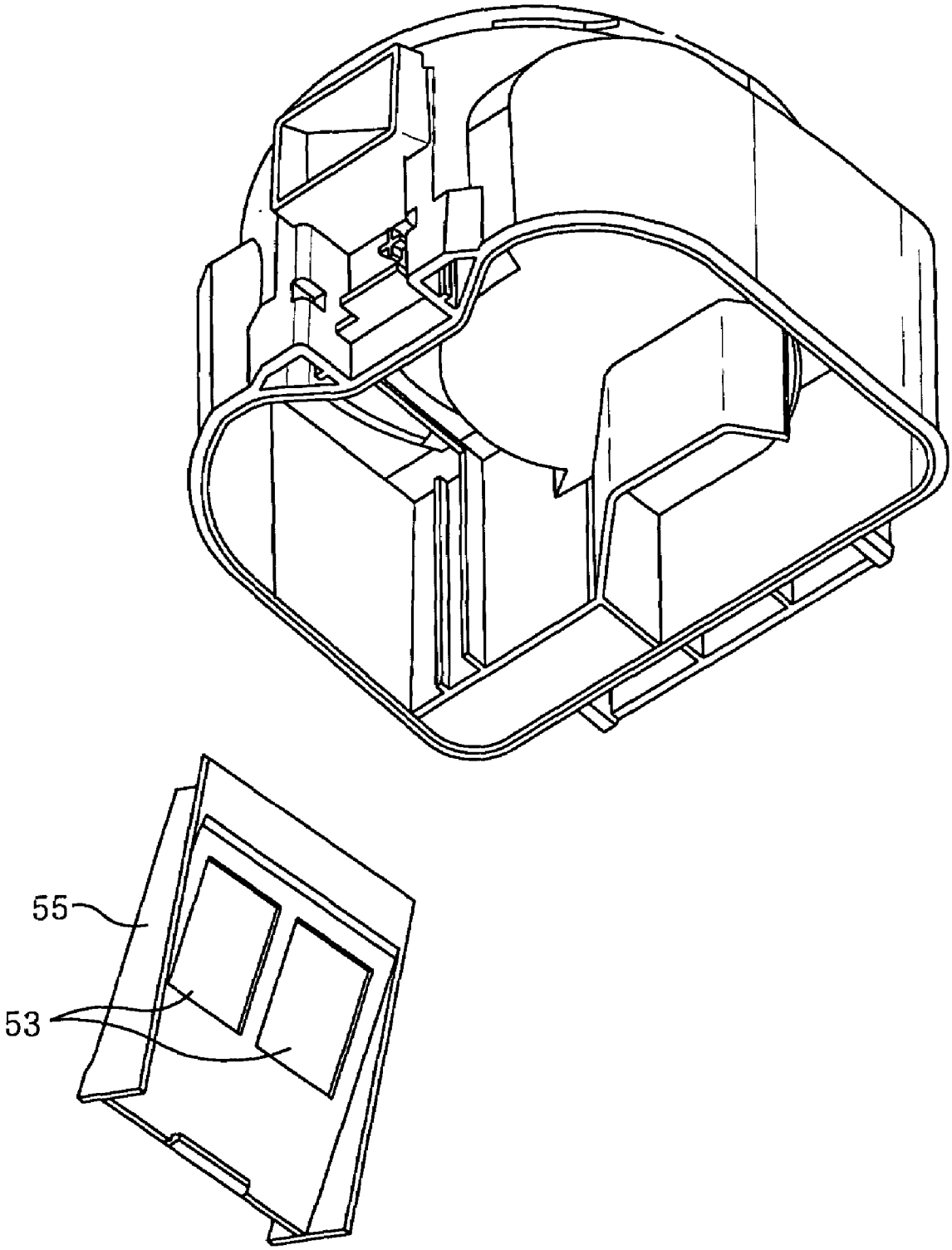
FIG. 18 provides a bottom perspective view of the dirt collecting part with ~ separated.

FIG. 17 is a view taken from a direction indicated by arrow A in FIG. 14. Reference numeral 50 represents a fine dirt accumulation section which communicates with first opening 45 and is integrally formed with the bottom thereof. Further, reference numeral 43 represents a high-dense dirt accumulation section disposed in first dirt separation unit 36 for accumulating therein dirt particles of high density separated from a suction air stream in first dirt separation unit 36, and reference numeral 54, a low-dense dirt accumulation section disposed in first dirt separation unit 36 for accumulating therein dirt particles of low density separated from the suction air stream in first dirt separation unit 36. High-dense and low-dense dirt accumulation section 43 and 54 are separated from each other by partition wall 52. Further, high-dense dirt accumulation section 43 is disposed farther from first inlet port 39 than low-dense dirt accumulation section 54. Low-dense dirt accumulation section 54 has second opening 51 covered with filter 53. Reference numeral 49 represents a second communication opening through which a suction port (not shown) of electric blower 33 communicates with low-dense dirt accumulation section 54 via second opening 51. That is, second opening 51 serves as a communication passage between the suction port (not shown) of electric blower 33 and low-dense dirt accumulation section 54. Further, filter 53, as shown in FIG. 18, is installed on flat-shaped frame 55 which can be removably attached to second opening 51, thereby making it easy to clean filter 53. Filter 53 is located at a desired level from the bottom of second opening 51 (or the bottom of low-dense dirt accumulation section 54).

Figure 19:
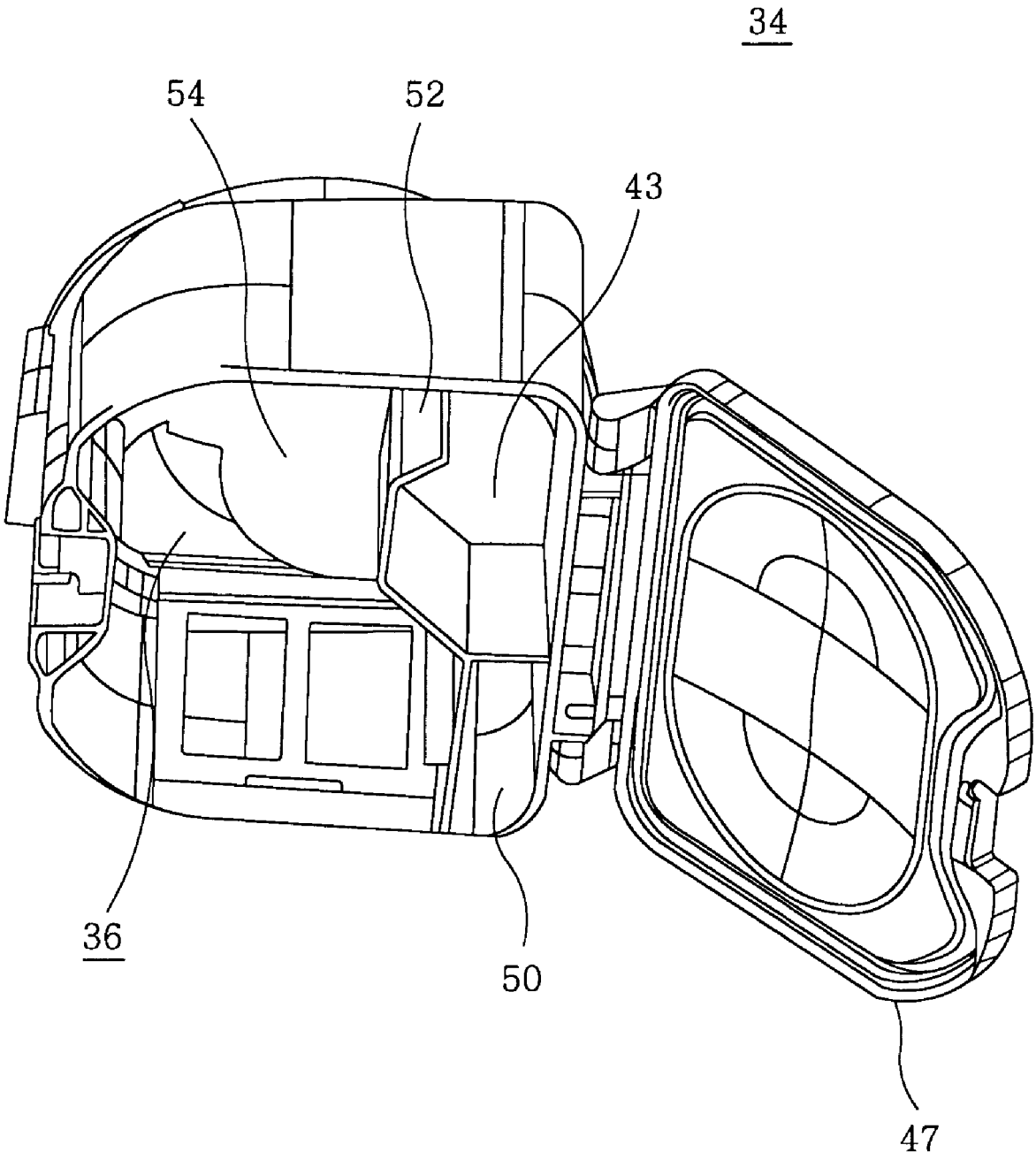
FIG. 19 sets forth a bottom perspective view of the dirt collecting part as viewed in another direction.

FIG. 19 is a perspective view of dirt collecting unit 34 as viewed from below. In first dirt separation unit 36, high-dense dirt accumulation section 43, low-dense dirt accumulation section 54 and fine dirt accumulation section 50 are horizontally disposed parallel to each other. High-dense and low-dense dirt accumulation section 43 and 54 are disposed in a manner that, when main body 48 of the vacuum cleaner is disposed upright with a rear side thereof facing a floor to be cleaned, they are overlapped in a vertical direction. (In this embodiment, high-dense dirt accumulation section 43 is disposed at a lower position.)

Operation of such arrangements will now be described. Dirt particles suctioned from suction inlet unit 31 pass through inside of hose 35 and are then introduced through first inlet port 39 into first dirt separation unit 36. A suction air stream including the dirt particles introduced into first dirt separation unit 36 through first inlet port 39 flows along outer wall portion 44 of centrifugal separation part 37. In first dirt separation unit 36, as shown in FIG. 17, a greater volume of dirt particles are likely to be suctioned by a suction force exerted to low-dense dirt accumulation section 54 and, since a heavy dirt particle experiences a higher centrifugal force, the centrifugal force of a high density of dirt particles becomes greater than that of a low density of dirt particles. Accordingly, dirt particles of high density pass through a leading end opening of partition wall 52 to be accumulated in high-dense dirt accumulation section 43 located farther from first inlet port 39 than low-dense accumulation section 54, and the dirt particles of low density are accumulated in low-dense accumulation section 54 near first inlet port 39.

Furthermore, since there is provided second opening 51 which allows low-dense accumulation section 54 to communicate with the suction port (not shown) of electric blower 33, the dirt particles of low density are accumulated from a position in the vicinity of second opening 51 in low-dense accumulation section 54. In particular, since the dirt particles of low density are almost those having a good air-permeability such as cottons or tissues which have a small mass and a large volume and filter 53 covering second opening 51 is located at a certain level from the bottom of second opening 51 (or the bottom of low-dense dirt accumulation section 54), occlusion of filter 53 is prevented, thereby enhancing reliability of dirt suctioning performance of the vacuum cleaner.

In addition, dirt particles of high density having a small volume are confined by partition wall 52 and accumulated in high-dense dirt accumulation section 43 which does not experience the suction force, so that they do not adhere to filter 53, thereby preventing occlusion of filter 53.

Further, the suction force exerting on low-dense dirt accumulation section 54 prevents the dirt particles of low density accumulated in low-dense dirt accumulation section 54 from floating upward so that dirt particles are prevented from adhering to the filter of second inlet port 40 of centrifugal separation part 37. The suction air stream including dirt particles suctioned in first dirt separation unit 36 flows along the filter of second inlet port 40 provided in outer wall portion 44 of centrifugal separation part 37, thereby cleaning the filter of second inlet port 40.

Dirt particles having a great mass and a large volume are trapped in first dirt separation unit 36, but fine dirt particles having a small mass and a low volume are suctioned via second inlet port 40 into centrifugal separation part 37. The suction air stream including dirt particles suctioned into centrifugal separation part 37 is divided into an airflow and the dirt particles while flowing through circular passageway 41*a* defined by outer and inner wall portion 44 and 41, the airflow being introduced into the inside of inner wall portion 41 from an opening section on the downstream side of circular passageway 41*a*. Since only the inside of inner wall portion 41 communicates through first communication opening 42 with the suction port (not shown) of electric blower 33, the airflow is discharged to the outside of main body 48 via first communication opening 42. Further, sectional area of circular passageway 41*a* is gradually decreased and velocity of the air stream is increased accordingly as moving along toward downstream thereof so that separation of the airflow and the dirt particles are facilitated, thereby enhancing dirt collecting performance of vacuum cleaner.

The dirt particles separated from the airflow are introduced through first opening 45 into fine dirt accumulation section 50 and accumulated therein. Since fine dirt accumulation section 50 is closed by lid 47, there occurs no air stream therein so that the dirt particles are positively accumulated therein. Accordingly, the dirt particles, which are centrifugally separated by centrifugal separation part 37 and accumulated in fine dirt accumulation section 50, are prevented from reflowing into centrifugal separation part 37. Further, since high-dense dirt accumulation section 43, low-dense accumulation section 54 and fine dirt accumulation section 50 each of which has an opened bottom are horizontally disposed parallel to each other in first dirt separation unit 36, by opening lid 47, dirt particles accumulated therein are simultaneously dropped together with the dirt particles trapped in first dirt separation unit 36.

Further, in case main body 48 of the vacuum cleaner is disposed upright with the rear side thereof facing a floor to be cleaned, high-dense and low-dense dirt accumulation section 43 and 54 are overlapped in a vertical direction. In this embodiment, high-dense dirt accumulation section 43 is disposed at a lower position and the leading end opening of partition wall 52 faces toward a side direction, so that the dirt particles of high density and of low density accumulated in high-dense and low-dense dirt accumulation section 43 and 54, respectively, do not escape therefrom and the particles of high density cannot move to low-dense dirt accumulation section 54 to thereby prevent occlusion of filter 53 covering second opening 51 by the particles of high density.

Moreover, although, in this embodiment, two dirt accumulation sections, i.e., high-dense and low-dense dirt accumulation section 43 and 54 in which the particles of high density and of low density are accumulated, respectively, are disposed in first dirt separation unit 36, three or more dirt accumulation sections may be provided in considering properties (density, weight, size or the like) of dirt particles.

A vacuum cleaner in accordance with a third preferred embodiment of the present invention will now be described with reference to FIGS. 20 to 25.

Figure 20:
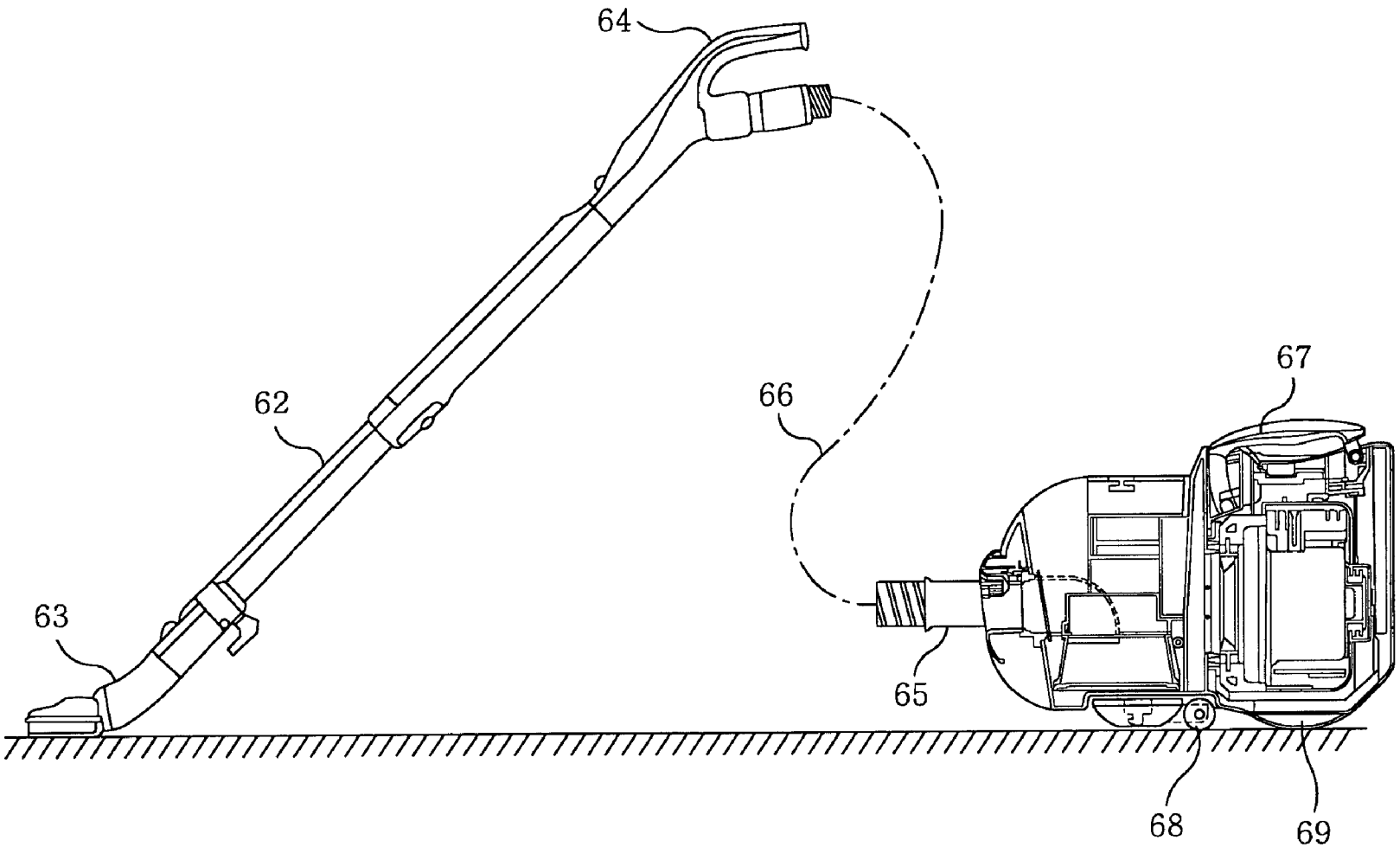
FIG. 20 illustrates an entire structural view of a vacuum cleaner in accordance with a third preferred embodiment of the present invention.

Referring to FIG. 20, the vacuum cleaner includes suction inlet unit 63 mounted on extension tube 62 into which dirt particles are suctioned. Extension tube 62 is connected to main body 67 via handle 64 and hose 66 with joint 65. Main body 67 includes a front caster rotatably supported by a shaft and a pair of rear wheels 69.

Figure 21:
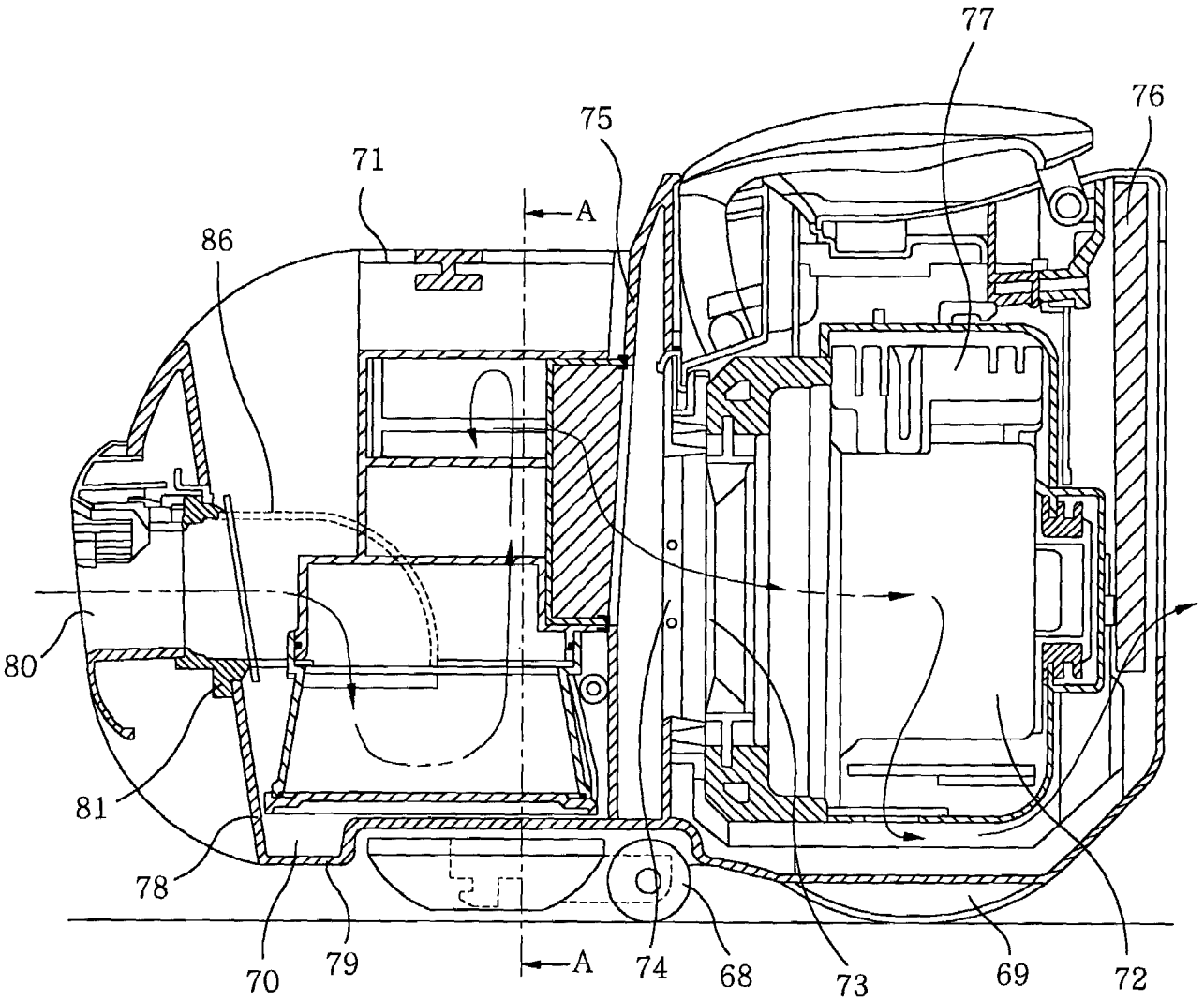
FIG. 21 shows a side sectional view of a main body of the vacuum cleaner.

As shown in FIG. 21, detachably mounted in recessed portion 70 provided at a front portion of main body 67 is a dirt collecting case 71 which serves as a dirt collecting unit for separating and trapping dirt particles from a suction air stream suctioned from suction inlet unit 63 and flowing through an inner passage (not shown) of hose 66 to main body 67. Further, electric blower 72 for generating the suction air stream is installed behind recessed portion 70 in main body 67. A suction side of electric blower 72 communicates with air suction port 74 via opening 73. Air suction port 74 is surrounded by slant sealing member 75 which abuts on dirt collecting case 71 when the latter is installed in main body 67. Exhaust air filter 76 is disposed at a rear portion of main body 67 and an exhaust air stream from electric blower 72 passes through exhaust air filter 76 to be discharged to an outside of main body 67. In addition, other components, e.g., an electric system such as controller 77 for controlling a power consumption of electric blower 72 and/or a cord winding mechanism (not shown) for winding in main body 67 a cord for supplying electric power to electric blower 72 are installed in main body 67.

Front wall 78 of main body 67 is erected from bottom wall 79 of a bottom of recessed portion 70. Provided at an approximately center portion of front wall 78 is air inlet port 80 to which hose joint 65 is detachably connected. Seal packing 81 is installed on an inner end of air inlet port 80 to prevent air leakage between air inlet port 80 and dirt collecting case 71.

Figure 22:
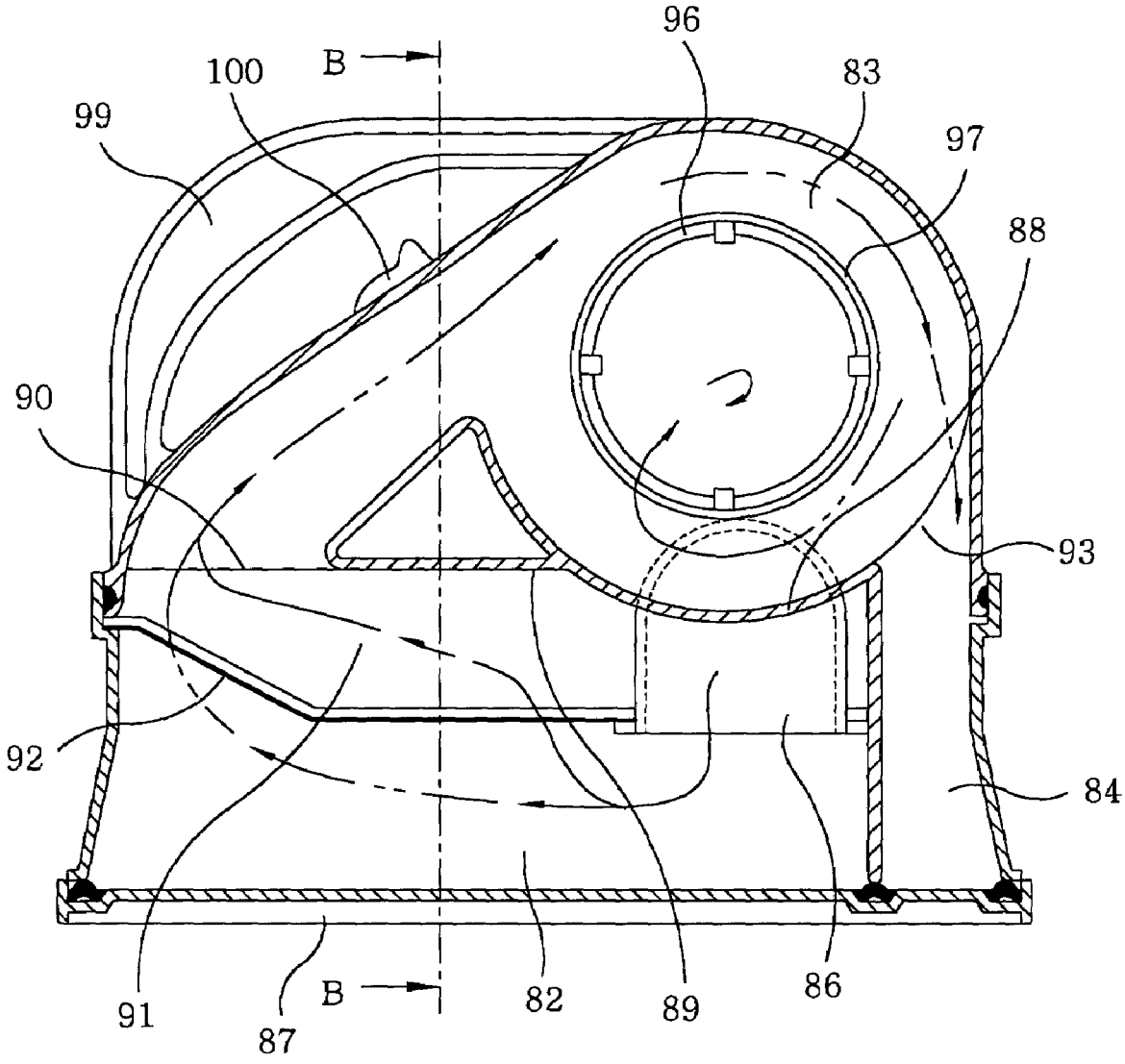
FIG. 22 depicts a cross sectional view taken along line A-A in FIG. 21.
Figure 23:
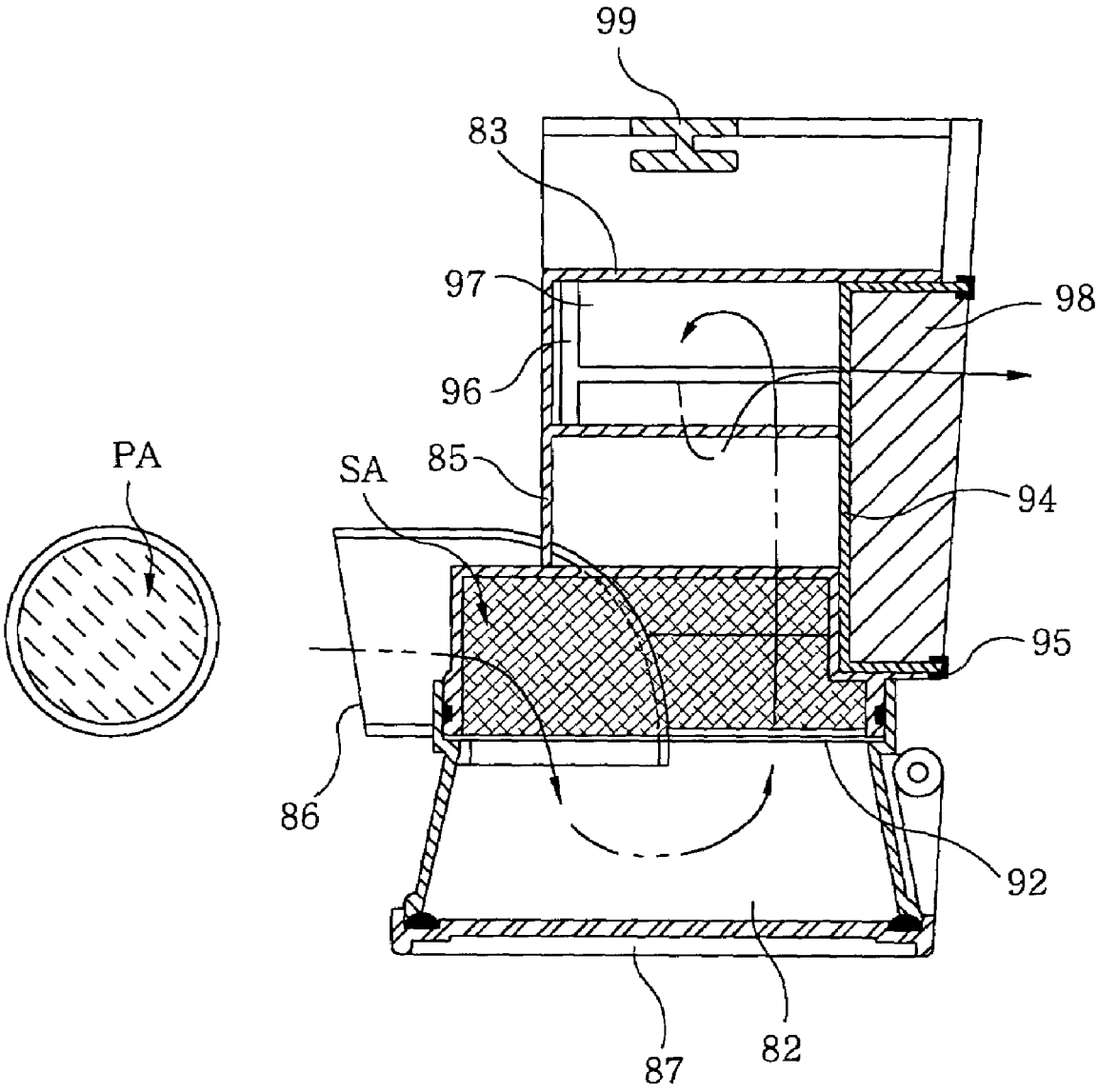
FIG. 23 shows a cross sectional view taken along line B-B in FIG. 22.

Referring to FIGS. 22 to 24, dirt collecting case 71 includes bulky dirt containing chamber 82 disposed at a lower portion of dirt collecting case 71 for separating and accommodating bulky dirt particles from a dirt-laden air stream passing through air inlet port 80, centrifugal separation chamber 83 disposed overlapping with bulky dirt containing chamber 82 (in this embodiment, the former is laid over the latter), the centrifugal separation chamber 83 serving as a fine dirt separation chamber for separating fine dirt particles from the air stream having substantially no bulky dirt particles, and fine dirt containing chamber 84 in which fine dirt particles centrifugally separated in centrifugal separation chamber 83 are accumulated, fine dirt containing chamber 84 being disposed under centrifugal separation chamber 83 and parallel to bulky dirt containing chamber 82. Bulky and fine dirt containing chamber 82 and 84 are separated from each other. Inlet port 86 is provided in front wall 85 of dirt collecting case 71 such that one end of inlet port 86 is aligned concentric with air inlet port 80 to communicate therewith when dirt collecting case 71 is set in main body 67 and the other end communicates with bulky dirt containing chamber 82.

Figure 24A:
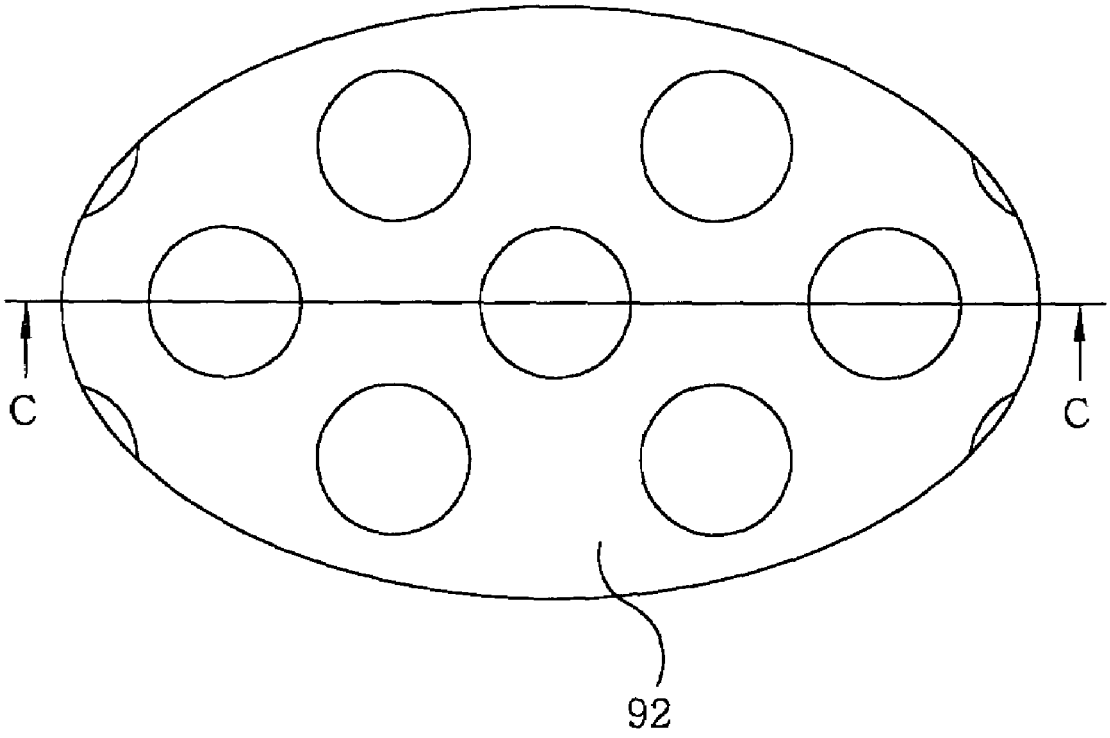
FIG. 24A is an enlarged top view of a primary filter.
Figure 24B:
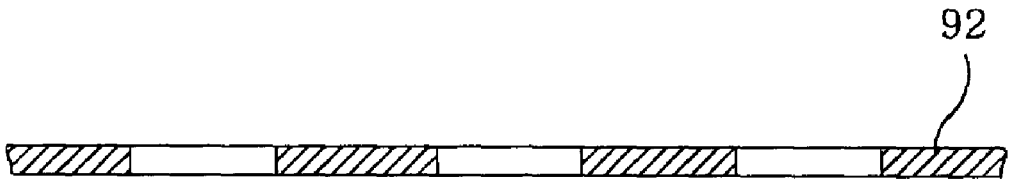
FIG. 24B is a cross sectional view taken along line CC in FIG. 24A.

In FIG. 22, bulky dirt containing chamber 82 includes lid 87 for closing and opening the bottom thereof and communicates with centrifugal separation chamber 83 via primary filter 92 serving as a bulky dirt trapping unit. Primary filter 92 separates bulky dirt particles from a suction air stream including dirt particles introduced into bulky dirt containing chamber 82 and confines them therein, whereby bulky dirt particles are accumulated in bulky dirt containing chamber 82. Further, as shown in FIGS. 24A and 24B, primary filter 92 is made of a plastic plate provided with a number of apertures and has a central portion disposed horizontal and side portions inclined upward against lid 87.

Disposed between primary filter 92 and centrifugal separation chamber 83 is isolation wall 89 which is formed integrally with wall 88 of centrifugal separation chamber 83 and spaced apart from primary filter 92 by a distance. Isolation wall 89 has at its end portion first communication opening 90 communicating with an upstream side of centrifugal separation chamber 83. To this end, air flow space 91 is provided between bulky dirt containing chamber 82 and centrifugal separation chamber 83, and inlet port 86 is located opposite to first communication opening 90 with respect to a vertical axis of dirt collecting case 71. In this embodiment, as viewed from the front side of dirt collecting case 71, inlet port 86 and first communication opening 90 are disposed at both end portions of dirt collecting case 71, respectively.

As viewed from the front side of dirt collecting case 71, centrifugal separation chamber 83 is disposed in an upper right portion thereof and formed in an approximately cylindrical configuration by separation chamber wall 88. First communication opening 90 and centrifugal separation chamber 83 communicate with each other and are disposed in such a way that an air stream introduced via first communication opening 90 into centrifugal separation chamber 83 travels tangentially along separation chamber wall 88. Further, separation chamber wall 88 has second communication opening 93 through which centrifugal separation chamber 83 communicates with fine dirt containing chamber 84. As illustrated in FIG. 22, second communication opening 93 is provided on a side portion of separation chamber wall 88 and fine dirt particles centrifugally separated in centrifugal separation chamber 83 are introduced through second communication opening 93 into fine dirt containing chamber 84 as indicated by the arrows.

Referring to FIG. 23, cover plate 94 is provided with packing 95 fitted on a circumferential end thereof and is tightly and detachably fitted into an opening of dirt collecting case 71 facing the air suction port of electric blower 72. Under the condition that dirt collecting case 71 is mounted in recessed portion 70, packing 95 slightly presses against slant sealing member 75, thereby preventing ambient air outside main body 67 from entering air suction port 74.

As shown in FIGS. 22 and 23, reference numeral 97 represents a secondary filter which is disposed in centrifugal separation chamber 83 in a substantially concentric relationship therewith. Secondary filter 97 includes cylindrical filter frame 96 having a plurality of air-through holes on its periphery and non-woven filter 98 is disposed at a rear (downstream) side of secondary filter 97 for filtering off fine dirt particles. Handle 99 is provided on dirt collecting case 71. Disposed near handle 99 is buckle button 100 which is manipulated at a time when lid 87 is closed or opened. Buckle button 100 receives a bias force of a spring (not shown) to release a retaining lever (not shown) of lid 87.

Operation of such arrangements will now be described.

When electric blower 72 is operated, an air stream including dirt particles is suctioned from suction inlet unit 63 and flows through extension tube 62 and hose 66 into air inlet port 80. After introduced through inlet port 86 into bulky dirt containing chamber 82, the air stream passes through primary filter 92. At that time, dirt particles of a size greater than those of the apertures of primary filter 92 are trapped by primary filter 92 and accumulated in bulky dirt containing chamber 82. Dirt particles of a size less than those of the apertures of primary filter 92 pass through primary filter 92 and first communication opening 90 into centrifugal separation chamber 83 together with the air stream.

The dirt-laden air stream introduced into centrifugal separation chamber 83 travels tangentially along separation chamber wall 88 to circulate therein. At that time, since dirt particles circulating in centrifugal separation chamber 83 experience centrifugal forces, they fly through second communication opening into fine dirt containing chamber 84 while traveling along separation chamber wall 88.

The air stream having substantially no dirt particles flows through secondary filter 97 and non-woven filter 98 and is then suctioned via air suction port 74 into electric blower 72. Thereafter, the air stream flows through exhaust air filter 76 and dirt particles which may still be included therein are filtered off by exhaust air filter 76. The air stream is then evacuated to outside of main body 67.

Dirt particles accumulated in bulky dirt containing chamber 82 is compressed by a pressure of the air stream passing through primary filter 92 to centrifugal separation chamber 83 so that a volume of dirt particles greater than that of bulky dirt containing chamber 82 can be accumulated therein. Particularly, such effects are increased when fibrous particles having a great bulk per mass are suctioned.

When a user removes the dirt particles collected in dirt collecting case 71, the user grips handle 99 and takes out dirt collecting case 71 from main body 67. Then, the user manipulates buckle button 100 provided near handle 99 to open lid 87 so that bulky dirt containing chamber 82 and fine dirt containing chamber 84 can simultaneously be opened and the dirt particles accumulated therein can be removed to, e.g., a trash can. Even if any dirt particles adhere to an inner surface of dirt collecting case 71, they can be removed by a sanitary manner, e.g., using water.

As described above, the dirt particles in bulky dirt containing chamber 82 are pressed against primary filter 92 and compressed by the air stream flowing through first communication opening 90 to centrifugal separation chamber 83. By providing primary filter 92 for trapping bulky dirt particles at upstream of centrifugal separation chamber 83, it is possible to avoid premature deterioration in flow rate due to occlusion of secondary filter 97 in centrifugal separation chamber 83. For example, in a conventional vacuum cleaner of a centrifugal separation type, while a dirt-laden air stream travels through a centrifugal separation chamber, dirt particles are separated therefrom. Accordingly, in case vinyl materials, tissue papers or fibrous particles having a low specific weight and a great volume are suctioned, they adhere to a filter in the centrifugal separation chamber, thereby resulting in a rapid deterioration in flow rate or even a failure of suction performance. In the present invention, however, bulky dirt particles are first removed from a dirt-laden air stream and fine dirt particles are then centrifugally separated therefrom, thereby preventing any rapid deterioration in flow rate.

Next, inlet port 86 and first communication opening 90 are substantially diagonally disposed with respect to the vertical axis of dirt collecting case 71 so that bulky dirt particles are effectively compressed in bulky dirt containing chamber 82. That is, it is most effective in compression to locate inlet port 86 and first communication opening 90 at opposite end portions of bulky dirt containing chamber 82.

Further, bulky dirt particles introduced from inlet port 86 into bulky dirt containing chamber 82 adhere to primary filter 92 in a vicinity of first communication opening 90. By providing air flow space 91 on a downstream side of primary filter 92, as the air permeability of regions of primary filter 92 to which the bulky dirt particles adhere is deteriorated, other bulky dirt particles adhere to neighboring regions. Accordingly, bulky dirt particles come to be sequentially compressed against and accumulated on the entire area of primary filter 92 from a region immediately below first communication opening 90 to a region near inlet port 86. As a result, by air flow space 91 serving as a passageway from inlet port 86 to first communication opening 90 regardless of the accumulation of dirt particles, the suction and compression can be performed without any rapid deterioration in flow rate until bulky dirt containing chamber 82 is fully filled with bulky dirt particles.

Further, the size of air flow space 91 can be made as large as possible. However, since an increase in size of air flow space 91 results in an increase in entire size of dirt collecting case 71, a standard size of air flow space 91 will now be described. As shown in FIG. 23, it is one of requirements for maintaining an initial suction force constant and avoiding a decrease in a sectional area of a passageway that minimum sectional area SA in air flow space 91 is set to be larger than sectional area PA of inlet port 86 serving as an inlet of a dirt-laden air stream.

In addition, by making a surface of primary filter 92 flat on the side of bulky dirt containing chamber 82, fibrous particles hung on the surface of primary filter 92 are reduced upon suction and compression thereof and are readily released from the surface upon disposal thereof. Further, although primary filter 92 is made of a plastic plate with a number of holes in this embodiment, it may be made of a metal plate having numerous holes formed by, e.g., a punching process.

Moreover, at least a portion of primary filter 92 is slant with respect to lid 87 so that, when dirt particles accumulated in bulky dirt containing chamber 82 are discharged therefrom, the dirt particles slide along the slant portion of primary filter 92 to thereby facilitate the discharge thereof. In this embodiment, both sides of bulky dirt containing chamber 82 are slanted upwardly.

Figure 25:
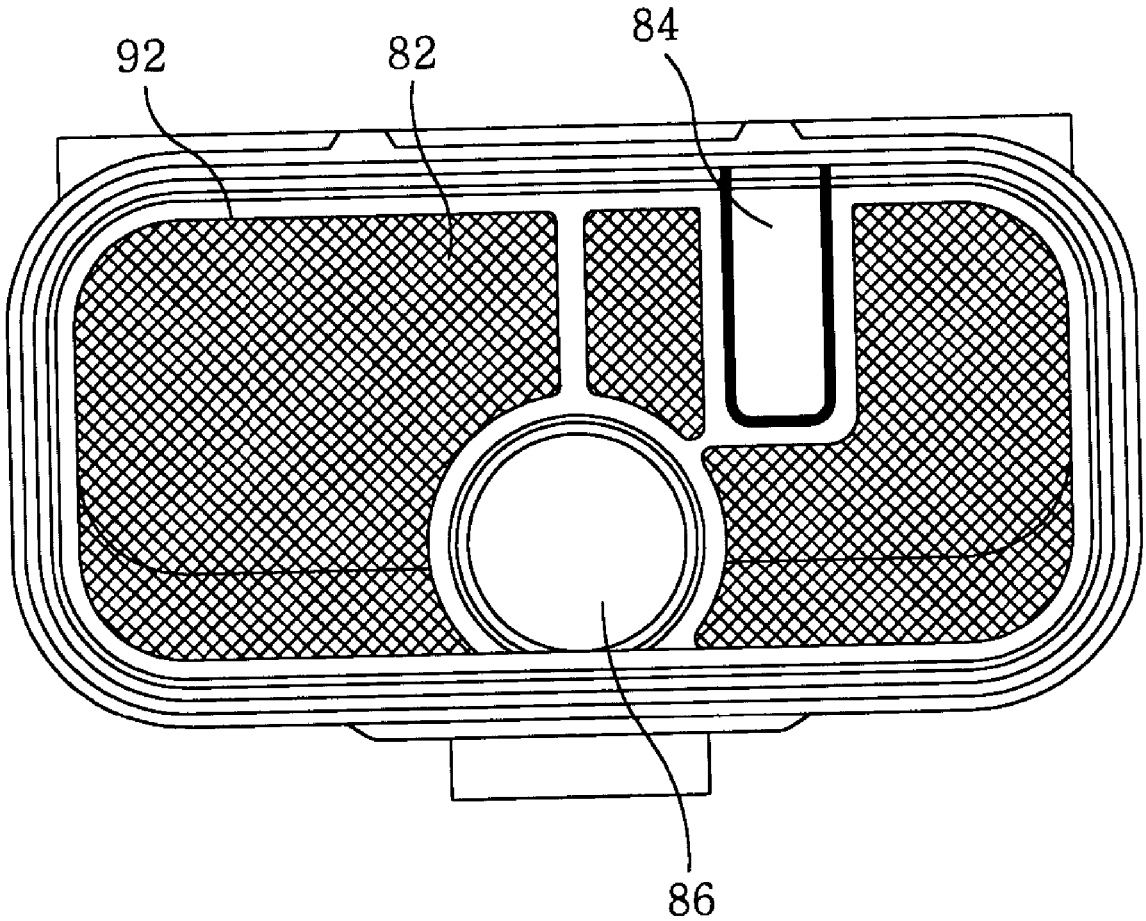
FIG. 25 represents a view as viewed in a direction indicated by arrow C in FIG. 24A (when dirt collecting cover 87 of a dirt accommodating chamber is opened)
Figure 26:
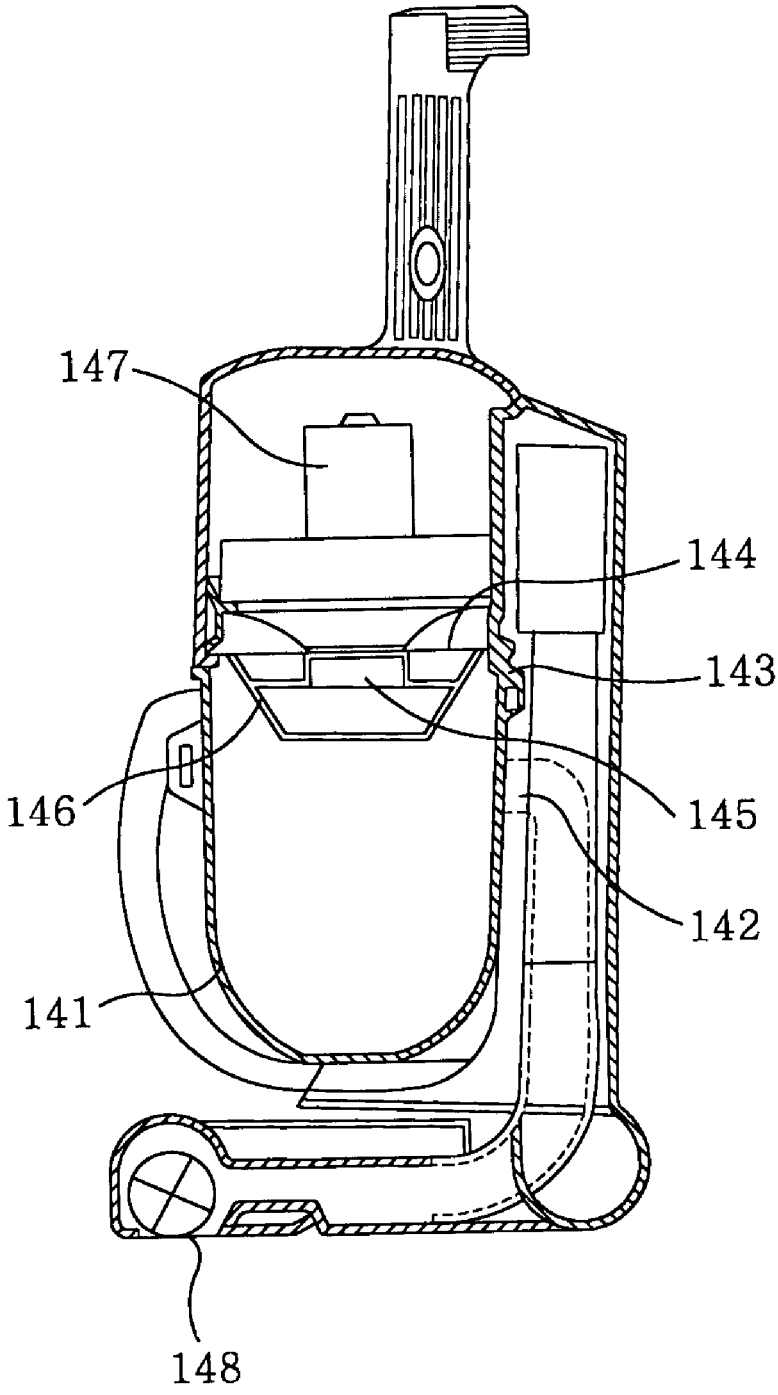
FIG. 26 (PRIOR ART)
FIG. 26 sets forth a schematic view of a conventional vacuum cleaner.

In connection with a volume ratio between bulky dirt containing chamber 82 and fine dirt containing chamber 84, the volume of fine dirt containing chamber 84 occupies from about 10% to about 20% of the total containing volume as illustrated in FIG. 25. This is set based on an analysis result showing that a percentage of fine dirt particles (which may pass through the holes of primary filter 92) is about 15% in a common house. As a result, upon cleaning a house, bulky dirt particles and fine dirt particles can be accumulated at a same rate so that a situation rarely occurs wherein fine dirt containing chamber 84 is not filled while bulky dirt containing chamber 82 is fully filled, thereby efficiently using dirt containing chamber.

While the invention has been shown and described with respect to the preferred embodiment, it will be understood by those skilled in the art that various changes and modifications may be made without departing from the spirit and scope of the invention as defined in the following claims.

What is claimed is:

1. A vacuum cleaner comprising:

a first dirt separation unit having a first inlet port through which a suction air stream including dirt particles is introduced thereinto; and a second dirt separation unit having a second inlet port through which the air stream introduced in the first dirt separation unit is introduced into the second dirt separation, wherein the first and the second inlet port are disposed not to face each other, and wherein a filter is installed on the second inlet port of the second dirt separation unit.

2. The vacuum cleaner of claim 1, wherein a guide member is provided for circulating the air stream introduced into the first dirt separation unit.

3. The vacuum cleaner of claim 1, wherein the first dirt separation unit separates dirt particles from the air stream by using a centrifugal force thereof.

4. The vacuum cleaner of claim 1, wherein the second dirt separation unit has an outer wall portion defining a substantially circular space, and an inner wall portion for circulating the suction air stream including dirt particles is disposed along the outer wall portion.

5. A vacuum cleaner comprising:

a first dirt separation unit having a first inlet port through which a suction air stream including dirt particles is introduced thereinto;

a second dirt separation unit having a second inlet port through which the air stream introduced into the first dirt separation unit is introduced into the second dirt separation; and an electric blower for generating the suction air stream, wherein the second dirt separation unit communicates with the electric blower through a first communication opening and the first dirt separation unit communicates with the electric blower through a second communication opening.

6. The vacuum cleaner of claim 5, wherein a filter is installed on each of the second inlet port of the second dirt separation unit, the first communication opening and the second communication opening.

7. The vacuum cleaner of claim 6, wherein a mesh size of the filter installed on the first communication opening is equal to or less than that of the filter installed on the second inlet port of the second dirt separation unit.

8. The vacuum cleaner of claim 6, wherein a mesh size of the filter installed on the second communication opening is equal to or less than that of the filter installed on the second inlet port of the second dirt separation unit.

9. The vacuum cleaner of claim 5, wherein a filter is installed on the second inlet port of the second dirt separation unit.

10. The vacuum cleaner of claim 5, wherein a guide member is provided for circulating the air stream introduced into the first dirt separation unit.

11. The vacuum cleaner of claim 5, wherein the first dirt separation unit separates dirt particles from the air stream by using a centrifugal force thereof.

12. The vacuum cleaner of claim 5, further comprising a dirt collecting cover having the first communication opening which communicates with the second dirt separation unit, the dirt collecting cover being disposed on a downstream side of the second dirt separation unit, wherein the dirt collecting cover is detachably connected to the second dirt separation unit.

13. The vacuum cleaner of claim 5, wherein the second dirt separation unit has an outer wall portion defining a substantially circular space, and an inner wall portion for circulating the suction air stream including dirt particles is disposed along the outer wall portion.

14. A vacuum cleaner comprising:

a first dirt separation unit having a first inlet port through which a suction air stream including dirt particles is introduced thereinto;

a second dirt separation unit having a second inlet port through which the air stream introduced in the first dirt separation unit is introduced into the second dirt separation; and a dirt collecting cover having a first communication opening which communicates with the second dirt separation unit, the dirt collecting cover being disposed on a downstream side of the second dirt separation unit, wherein the dirt collecting cover is detachably connected to the second dirt separation unit, wherein the first and the second inlet port are disposed not to face each other.

15. A vacuum cleaner comprising:

a first dirt separation unit having a first inlet port through which a suction air stream including dirt particles is introduced thereinto; and a second dirt separation unit having a second inlet port through which the air stream introduced in the first dirt separation unit is introduced into the second dirt separation, wherein the first and the second inlet port are disposed not to face each other, wherein the first dirt separation unit separates dirt particles from the air stream by using a centrifugal force thereof, and wherein the first dirt separation unit has a plurality of accumulation sections in which dirt particles separated are accumulated.

16. The vacuum cleaner of claim 15, wherein dirt particles separated in the first dirt separation unit are accumulated in the respective accumulation sections depending on their densities.

17. The vacuum cleaner of claim 16, wherein the first dirt separation unit has a high-dense dirt accumulation section in which dirt particles of high density separated from the suction air stream therein are accumulated, and a low-dense dirt accumulation section in which dirt particles of low density separated from the suction air stream therein are accumulated, the high-dense dirt accumulation section being located farther from the first inlet port of the first dirt separation unit than the low-dense dirt accumulation section.

18. A vacuum cleaner comprising:

an electric blower for generating a suction air stream a suction inlet unit for suctioning dirt particles by the suction air stream; and a dirt collecting unit for separating and trapping the dirt particles from the suction air stream, wherein the dirt collecting unit includes a bulky dirt containing chamber having an inlet port through which the suction air stream from the suction inlet unit is introduced thereinto and a fine dirt separation chamber for separating from the suction air stream dirt particles passing through the bulky dirt containing chamber, wherein the bulky dirt containing chamber communicates with the fine dirt separation chamber through a filter.

19. The vacuum cleaner of claim 18, wherein the fine dirt separation chamber is a centrifugal separation chamber in which dirt particles are centrifugally separated from the suctioning air stream.

20. The vacuum cleaner of claim 18, further comprising a dirt containing chamber including the bulky dirt containing chamber for accommodating dirt particles separated by the bulky dirt trapping member and a fine dirt containing chamber for accommodating dirt particles separated in the fine dirt separation chamber, and a dirt containing chamber lid openably covering the dirt containing chamber, wherein when the dirt containing chamber lid is opened, the bulky dirt containing chamber and the fine dirt containing chamber are simultaneously opened to outside.

21. The vacuum cleaner of claim 18, further comprising a dirt containing chamber including the bulky dirt containing chamber for accommodating dirt particles separated by the filter and a fine dirt containing chamber for accommodating dirt particles separated in the fine dirt separation chamber, and a dirt containing chamber lid openably covering the dirt containing chamber, wherein when the dirt containing chamber lid is opened, the bulky dirt containing chamber and the fine dirt containing chamber are simultaneously opened to outside.

* * * * *